US009168715B2

(12) United States Patent
Wetsch et al.

(10) Patent No.: US 9,168,715 B2
(45) Date of Patent: Oct. 27, 2015

(54) PACKAGING PILLOW DEVICE WITH UPSTREAM COMPONENTS

(75) Inventors: Thomas D. Wetsch, St. Charles, IL (US); Thomas F. McNellis, Tinley Park, IL (US)

(73) Assignee: PREGIS INNOVATIVE PACKAGING LLC, Deerfield, IL (US)

( * ) Notice: Subject to any disclaimer, the term of this patent is extended or adjusted under 35 U.S.C. 154(b) by 471 days.

(21) Appl. No.: 12/986,022

(22) Filed: Jan. 6, 2011

(65) Prior Publication Data

US 2011/0172072 A1 Jul. 14, 2011

Related U.S. Application Data

(60) Provisional application No. 61/292,815, filed on Jan. 6, 2010.

(51) Int. Cl.
*B31D 5/00* (2006.01)

(52) U.S. Cl.
CPC ..... *B31D 5/0073* (2013.01); *B31D 2205/0047* (2013.01); *B31D 2205/0058* (2013.01); *B31D 2205/0082* (2013.01); *B31D 2205/0088* (2013.01)

(58) Field of Classification Search
USPC ..... 53/452, 456, 459, 79, 558, 567, 574, 53/575–576, 266.1, 284.7
See application file for complete search history.

(56) References Cited

U.S. PATENT DOCUMENTS

| | | | | |
|---|---|---|---|---|
| 2,392,695 | A | | 1/1946 | Rohdin |
| 3,149,560 | A | | 9/1964 | Finke et al. |
| 3,660,189 | A | | 5/1972 | Troy |
| 3,868,285 | A | | 2/1975 | Troy |
| 4,017,351 | A | | 4/1977 | Larson et al. |
| 4,021,283 | A | * | 5/1977 | Weikert ..... 156/244.14 |
| 4,049,854 | A | * | 9/1977 | Casey et al. ..... 428/72 |
| 4,169,002 | A | * | 9/1979 | Larson ..... 156/145 |
| 4,172,750 | A | | 10/1979 | Giulie |
| 5,048,269 | A | | 9/1991 | Deni |
| 5,340,632 | A | * | 8/1994 | Chappuis ..... 428/71 |
| 5,417,041 | A | | 5/1995 | Hansen et al. |
| 5,537,804 | A | | 7/1996 | Tolson |
| 5,873,215 | A | * | 2/1999 | Aquarius et al. ..... 53/403 |
| 5,942,076 | A | * | 8/1999 | Salerno et al. ..... 156/359 |
| 6,195,966 | B1 | * | 3/2001 | Shomron et al. ..... 53/451 |

(Continued)

FOREIGN PATENT DOCUMENTS

| | | |
|---|---|---|
| EP | 1280651 | 2/2010 |
| WO | WO-02/14156 | 2/2002 |
| WO | WO 2006/101391 | 9/2006 |

OTHER PUBLICATIONS

International Search Report mailed on Feb. 15, 2012 for International Application No. PCT/US2011/020401.

(Continued)

*Primary Examiner* — Christopher Harmon

(74) *Attorney, Agent, or Firm* — Dorsey & Whitney LLP

(57) ABSTRACT

The disclosure describes a device for inflating and cutting a material web. The device can include a web advancement mechanism to advance a material web in a longitudinal path, an inflation mechanism for inserting a fluid into the material web to create one or more inflated pillows, a fluid inlet for providing the fluid to the inflation mechanism, and a cutting mechanism configured to cut the material web in the longitudinal path.

8 Claims, 21 Drawing Sheets

(56) References Cited

U.S. PATENT DOCUMENTS

| | | | | |
|---|---|---|---|---|
| 6,209,286 | B1 * | 4/2001 | Perkins et al. | 53/403 |
| 6,213,167 | B1 * | 4/2001 | Greenland | 141/10 |
| 6,410,119 | B1 * | 6/2002 | De Luca et al. | 428/166 |
| 6,460,313 | B1 | 10/2002 | Cooper | |
| 6,582,800 | B2 * | 6/2003 | Fuss et al. | 428/178 |
| 6,605,169 | B2 | 8/2003 | Perkins et al. | |
| 6,635,145 | B2 | 10/2003 | Cooper | |
| 6,656,946 | B2 | 12/2003 | Himmelsbach et al. | |
| 6,698,041 | B2 | 3/2004 | VanSteenburg et al. | |
| 6,786,022 | B2 | 9/2004 | Fuss et al. | |
| 6,889,739 | B2 * | 5/2005 | Lerner et al. | 156/498 |
| 6,932,134 | B2 | 8/2005 | Selle et al. | |
| 6,955,846 | B2 | 10/2005 | Lerner | |
| 7,040,073 | B2 | 5/2006 | Perkins et al. | |
| 7,059,097 | B2 | 6/2006 | Perkins et al. | |
| 7,125,463 | B2 | 10/2006 | Lerner et al. | |
| 7,185,474 | B2 | 3/2007 | Perkins et al. | |
| 7,325,377 | B2 | 2/2008 | Fuss et al. | |
| 7,328,541 | B2 | 2/2008 | Garceau et al. | |
| 7,343,723 | B2 * | 3/2008 | Perkins | 53/403 |
| 7,347,911 | B2 | 3/2008 | Selle et al. | |
| 7,513,090 | B2 | 4/2009 | Wehrmann | |
| 7,526,904 | B2 | 5/2009 | Fuss et al. | |
| 7,550,191 | B2 | 6/2009 | Lerner | |
| 7,571,584 | B2 | 8/2009 | Lerner et al. | |
| 7,578,333 | B2 | 8/2009 | Greenwood et al. | |
| 7,767,288 | B2 | 8/2010 | Lerner | |
| 7,913,474 | B2 * | 3/2011 | Aquarius | 53/403 |
| 2001/0013215 | A1 * | 8/2001 | Fuss et al. | 53/403 |
| 2002/0108352 | A1 * | 8/2002 | Sperry et al. | 53/403 |
| 2002/0162301 | A1 * | 11/2002 | Davey | 53/403 |
| 2003/0163976 | A1 * | 9/2003 | Perkins et al. | 53/403 |
| 2004/0206050 | A1 | 10/2004 | Fuss et al. | |
| 2006/0010835 | A1 | 1/2006 | Shaw et al. | |
| 2006/0011291 | A1 | 1/2006 | O'Dowd | |
| 2006/0090421 | A1 | 5/2006 | Sperry et al. | |
| 2006/0112663 | A1 | 6/2006 | Perkins | |
| 2006/0292320 | A1 | 12/2006 | Greenwood et al. | |
| 2007/0251190 | A1 | 11/2007 | Daigle et al. | |
| 2008/0066852 | A1 | 3/2008 | Wetsch | |
| 2009/0049803 | A1 | 2/2009 | Limousin | |
| 2009/0094939 | A1 * | 4/2009 | Wetsch | 53/79 |
| 2009/0110864 | A1 | 4/2009 | Wehrmann | |
| 2010/0051202 | A1 | 3/2010 | Greenwood et al. | |
| 2010/0251665 | A1 | 10/2010 | Sperry | |
| 2010/0251668 | A1 | 10/2010 | Sperry et al. | |

OTHER PUBLICATIONS

International Written Opinion mailed on Feb. 15, 2012 for International Application No. PCT/US2011/020401.

"Pregis Safety, Operation, and Maintenance Pregis AIRSPEED 5000 Air Cushion Machine Manual version 3, 2007".

International Search Report for the International Application No. PCT/US2008/079583.

* cited by examiner

PACKAGING PILLOW DEVICE WITH UPSTREAM COMPONENTS

CROSS REFERENCE TO RELATED APPLICATION

The present application claims priority from U.S. Provisional Ser. No. 61/292,815 filed Jan. 6, 2010, the disclosure of which is incorporated herein by reference in its entirety.

FIELD OF THE DISCLOSURE

The present disclosure relates to packaging materials, and more particularly is directed to devices and methods for manufacturing pillows to be used as packaging material.

BACKGROUND

Many techniques have been used to pack items for shipping and absorb impacts during shipment to protect shipped items. Popular shipping protection methods include the use of foam "peanuts," molded foam components, formed paper, and molded pulp packaging components.

A technique that has gained recent popularity involves inflating pillows from a film material. This style of packaging allows low-volume, uninflated materials to be shipped to packers, who then inflate the raw material into a shock-absorbing packing material that easily fits around items to be packaged within a container. Customized pillow inflating machines may be used at client sites to provide on-site pillow manufacturing.

Several concerns have arisen regarding pillows as a packaging material. It is important for pillow manufacturing machines to be compact, reliable, and easy to operate. Further, pillows should be quickly manufactured and adequately sealed to reduce the likelihood of leaking or bursting. In addition, pillow manufacturing devices should produce as little waste as possible in the form of underinflated or uninflated pillows.

SUMMARY

A preferred embodiment of the disclosure is material web inflating and cutting device. This embodiment can include a web advancement mechanism to advance a material web in a longitudinal path. An inflation mechanism is configured to insert a fluid into the material web to create one or more inflated pillows. The inflation mechanism can include a nozzle that has a fluid inlet and an inflation opening. A cutting mechanism can be provided configured and disposed to cut the material web in the longitudinal path to allow the web to pass over a portion of the inflation nozzle. The fluid inlet and the inflation opening can be disposed at least partially overlapping in the direction of the longitudinal path.

The fluid inlet and the inflation opening in one embodiment are substantially coaxial to provide a straight, transverse fluid flow into the web. Also, the cutting mechanism can include a blade protruding from the surface of the nozzle, and can be disposed upstream of the inflation opening along the longitudinal path.

A sealing mechanism can also be provided, which is configured and disposed for longitudinally sealing the inflated web upstream of a location at which the cutting mechanism cuts the material web, for sealing the fluid within the web. In some embodiments, the inflation and cutting mechanisms are assembled as a module that is removably mounted as a unit with respect to the web advancement mechanism. The cutting mechanism is disposed to cut the material web at a location along the longitudinal path at least partially overlapping the inflation opening for simultaneously cutting the web material as the inflation mechanism inflates the material web.

Some embodiments have a nozzle that has a guide portion upstream of the inflation opening that is angled with respect to the longitudinal axis at least in a direction perpendicular to an transverse axis of the web.

A modular embodiment of a material web inflating, cutting and sealing device can include a module that has an inflation mechanism configured to insert a fluid into a material web to create one or more inflated pillows, the inflation mechanism including an inflation nozzle for inserting the fluid into the material web; and a cutting mechanism configured to cut the material web as the material web passes over the inflation nozzle. The module can be removably mounted as a unit to a sealing mechanism that is configured for sealing the material web for sealing the fluid therein. The sealing mechanism, for example, can be configured for making a longitudinal seal to seal the inserted fluid between the web layers to form inflated pillows.

In another embodiment, the cutting mechanism can be configured and disposed to cut the material web at a first location along the longitudinal path simultaneously as the inflation mechanism inflates the material web. In this embodiment, the nozzle has an inflation opening at the first location. The cutting mechanism can have a blade protruding from the exterior surface of the nozzle at the first location.

In some embodiments, the sealing mechanism is downstream of a location at which the cutting mechanism cuts the material web. The sealing mechanism and/or the advancement mechanism can include a pinch portion to pinch opposing layers of the film together at a pinch location for sealing the layers. The cutting mechanism can be spaced upstream from the pinch location such that a portion of the web is substantially unsupported on an exterior side thereof between the cutting location and pinch location.

DETAILED DESCRIPTION

The present disclosure is related to systems and methods for converting uninflated material into inflated pillows that may be used as cushioning for packaging and shipping goods.

Figure 1:
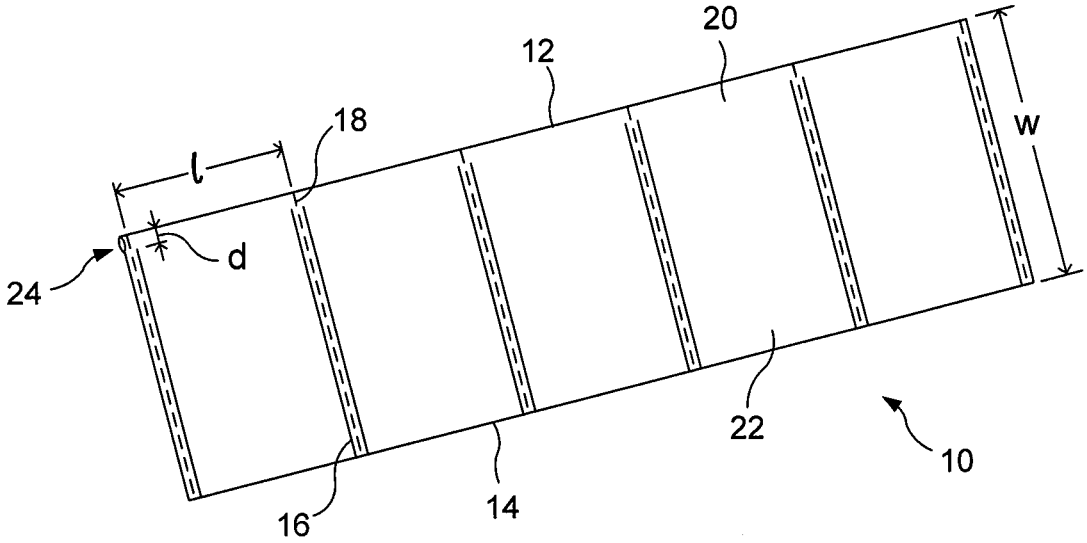
FIG. 1 is a top view of an uninflated material web according to an embodiment.
Figure 2:
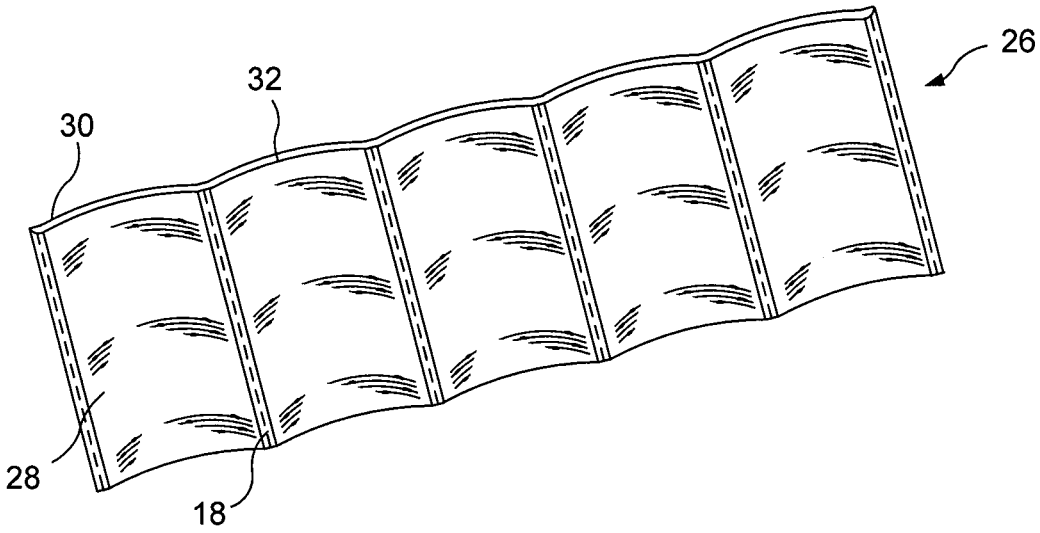
FIG. 2 is a top view of an inflated strand of pillows according to the embodiment of FIG. 1.

FIG. 1 shows an embodiment of a web 10 of uninflated material to be inflated and sealed into a series of pillows attached at perforated edges, as shown in FIG. 2, although different embodiments of web material are possible. The web 10 may be made of a variety of different materials, including films made of materials such as polyethylenic resins such as LDPE, LLDPE, HDPE; metallocenes; EVAs; and blends thereof, but is not limited to such. The web 10 preferably two layers of film preferably connected at a top edge 12 and a bottom edge 14, both of which are closed. The film layers may be connected by seals, by being continuous parts of a folded or tubular film, or by other suitable means. The connection is preferably fluid-, preferably air-, tight. The web 10 can include generally transverse seals 16 and generally transverse perforations 18. The transverse seals 16 join a top sheet 20 of the web 10 to a bottom sheet 22 of the web along the seals 16 to form inflatable chambers that are fluidly separate from each other when the pillows are formed, while the transverse perforations 18 perforate the web 10 through the top sheet 20 and bottom sheet 22 to facilitate breaking the pillows apart. Additional seals may be provided within the chambers, between the transverse seals 16, such as longitudinal seal segments. Also, the transverse and internal seals may be straight lines, or alternatively be curved, angled, bent, or have other suitable shapes.

According to the embodiment shown in FIG. 1, the transverse seals 16 can begin at the bottom edge 14 of the web 10 and extend to a distance d from the top edge 12. According to one embodiment of the present invention, the distance d is approximately 0.5 to 0.7 inches, though greater or smaller distances may be used according to some embodiments. Distances from about 0.25 inches to about 1.00 inch may also be used in some embodiments. Further, the web 10 has a width w, and a perforation-to-perforation length 1, which may be altered depending on the particular type of pillow to be manufactured.

Because the transverse seals 16 do not reach the top edge 12 of the web in the embodiment shown in FIGS. 1-2, an opening 24 is left between the end of a transverse seal 16 and the top edge 12 of the web. This opening 24 is generally used to feed the web 10 into an inflation machine according to an embodiment, which inflates and seals the web material 10 into the inflated strand of pillows 26 shown in FIG. 2. In FIG. 2, each inflated pillow 28 can be separated from a neighboring inflated pillow by a transverse perforation 18. According to one embodiment, small cutaway flaps 30 are left on the strand 26, as a remnant of the formation process, which will be explained below. A longitudinal seal 32 is formed along the strand 26, so that each inflated pillow 28 is sealed closed, trapping the inflation gas within the pillow.

Figure 3B:
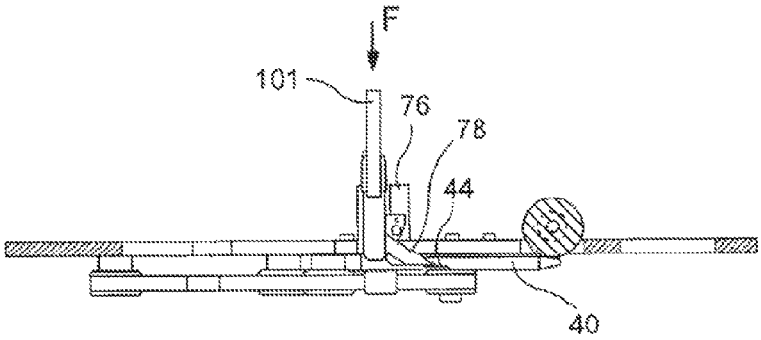
FIG. 3*b* is a top view taken along line A'-A' of the pillow inflating and sealing mechanism according to the embodiment of FIG. 3*a;*
Figure 3A:
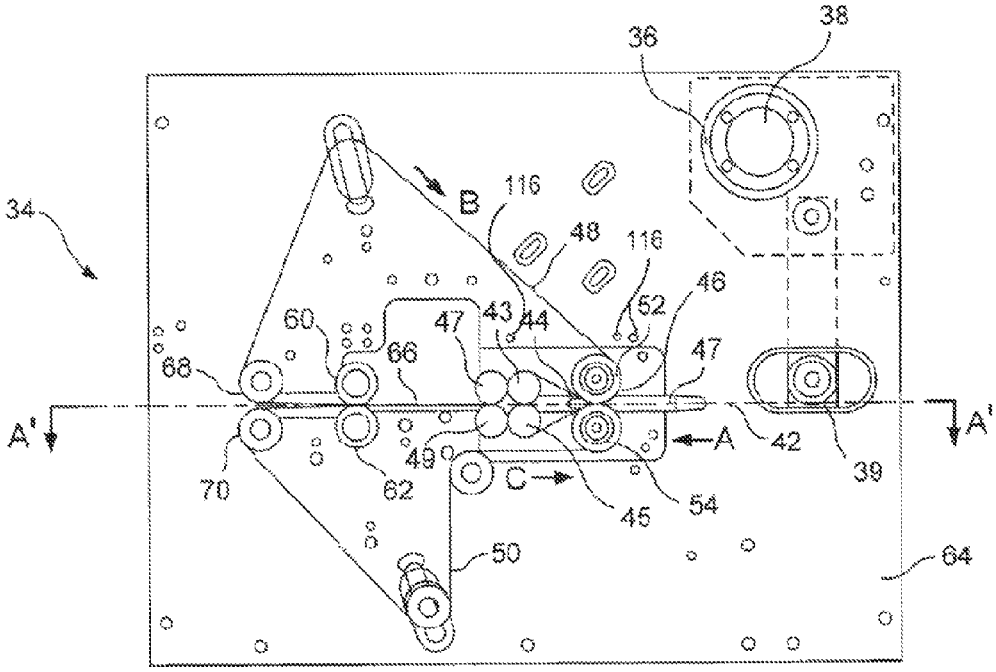
FIG. 3*a* is a side view of a pillow inflating and sealing machine according to an embodiment.

Turning now to FIG. 3*a*, an inflation and sealing machine 34 for converting the web 10 of uninflated material into a series of inflated pillows 28 according to an embodiment. As shown in FIG. 3*a*, the uninflated web 10 may be provided as a roll 36 of material provided on a roll axle 38. The material may be pulled through the machine in the path or direction shown by arrow "A" by a drive mechanism, and a guide roller 39 provided on a dancer arm 41 may be used to guide the web 10 away from the roll 36 and steadily toward the inflation mechanism. To prevent or inhibit bunching up of the material as it is unwound from the roll 36, the roll axle 38 may be provided with a brake to prevent or inhibit free unwinding of the roll 36 and to assure that the roll is unwound at a steady and controlled rate. According to one embodiment, a spring-loaded leather strap can be used as a drag brake on the roll axle 38.

To begin manufacturing of inflated pillows from the web material according to an embodiment of FIG. 3*a*, which provides a substantially straight or linear guide or pathway for the web material, the opening 24 in the web material (as shown in FIG. 1) is inserted around an inflation nozzle 40. Of course, other directions, such as a circular direction of the path, are possible in other embodiments. The inflation nozzle 40 inserts pressurized gas into the uninflated web material, inflating the material into inflated pillows 28, as shown in FIG. 2. The inflation nozzle 40 can be provided with either one or both of an end inflation hole 42 and a side inflation opening, such as hole 44 (more clearly shown in FIG. 3*c*). Although in the embodiments described fluid is only released through the side inflation hole 44, fluid can also be released at the end inflation hole 42. In the embodiments described, the end inflation hole is closed, so air is substantially only released through the side inflation hole 44. If the end inflation hole was open, when the opening 24 in the web would be fed around the end inflation hole 42, gas flowing through the end inflation hole 42 would begin to inflate the web material once it advances in the longitudinal path A or web advance direction. The inflation nozzle 40 can be a guide for the material web, and can comprise a hollow rod, a solid rod with an opening only at the side inflation hole 44 and to provide a path for the fluid, a tube, etc., and is not limited to such. The inflation nozzle 40 can be a straight longitudinal guide for the material web, or can be curved as well. A guide portion of the inflation nozzle 40 preferably extends forward of its inflation opening to be received in an inflation channel formed between layers of the film web. The inflation channel is preferably closed to trap the nozzle radially therein, until the web material around the nozzle is cut by the cutting mechanism.

In the embodiment of FIG. 3*a*, when a new roll 36 of material is fed into the machine 34, the uninflated web is first inserted by hand around the inflation nozzle 40 and toward a web feed area 46 where the web is placed between first and second drive belts 48 and 50. The first drive belt 48 is driven in the direction shown by the arrow "B" of FIG. 3*a*, and the second drive belt 50 is driven in the direction shown by arrow "C," such that the web will be driven in the direction of arrow "A" after being inserted into the web feed area 46. The web feed area 46 is located between a top insertion idler roller 52 and a bottom insertion idler roller 54, which respectively guide the first and second drive belts 48 and 50.

According to the embodiment of FIG. 3*a*, the first and second drive belts 48 and 50 are driven by a pair of nip rollers. A top post-seal nip roller 60 and a bottom post-seal nip roller 62 advance the drive belts 48 and 50, which in turn advance the web. According to one embodiment, the drive belts 48 and 50 can be coated with Teflon and the belts are substantially gripping and resilient to advance the web through the machine 34. According to some embodiments of the invention, the belts 48 and 50 may be made of Teflon-coated fiberglass or KEVLAR®. It is preferable to keep the belts narrow to facilitate more complete inflation of the pillows 28 as the web 10 is guided through the machine 34. According to one embodiment, only the bottom nip roller is directly driven by motors located behind a mounting plate 64, with power transferred to the top nip roller by gears located behind the mounting plate. One or more rollers can be used for the post-seal nip rollers.

After being fed into the web feed area 46, the web is advanced past the top insertion idler roller 52 and a bottom insertion idler roller 54, and then to the side inflation hole 44 of the inflation nozzle 40, and a fluid or inflation gas is inserted into the web to form inflated pillows 28. Once the web is inflated to form inflated pillows, the web is cut by a cutting mechanism, such as a removable blade member 76 having an angled cutting edge 78 protruding from the inflation nozzle 40 outer surface. The cutting edge 78 may be coated with titanium nitride to increase the cutting ability and wear resistance of the cutting edge 78. Various cutting mechanisms can be used and are not limited to the blade member and cutting edge, such as various blades, knives, sharp edges, rotating abrasive devices, etc.

Then, after the web is cut, the belts 48 and 50 continuously advance the web with inflated pillows past top cam rollers 43, 47 and bottom cam rollers 45, 49, and then past a heat sealing element 66, which forms a longitudinal seal 32 that is preferably continuous along the web by sealing the top and bottom sheets 20 and 22 of the web together. One or more cam rollers can be used. The sealing step can be accomplished by heating the top and bottom sheets 20 and 22 with the heat sealing element 66 through the first drive belt to melt them together. The inflated and sealed pillows are advanced between the top and bottom post-seal nip rollers 60 and 62 and exit the belts at top and bottom post-seal idler rollers 68 and 70. The longitudinal seal 32 can be cooled by cooling fans (not shown) as the seal exits the belts. Alternatively or additionally, the belts and/or rollers may be directly cooled downstream of sealing formation. Of course, various sealing mechanisms and methods can be used to seal the material web.

FIG. 3*b* illustrates a top view of the inflation and sealing mechanism 74 of the embodiment shown in FIG. 3*a* along line A'-A'. As can be seen, pressurized air may come through a pipe or hose 101 in direction F, perpendicular to the direction of the nozzle 40, and then into the nozzle 40. The pressurized air is then used to inflate the web material. The pressurized air can be any fluid, such as gas, air, pressurized air, etc.

Figure 3C:
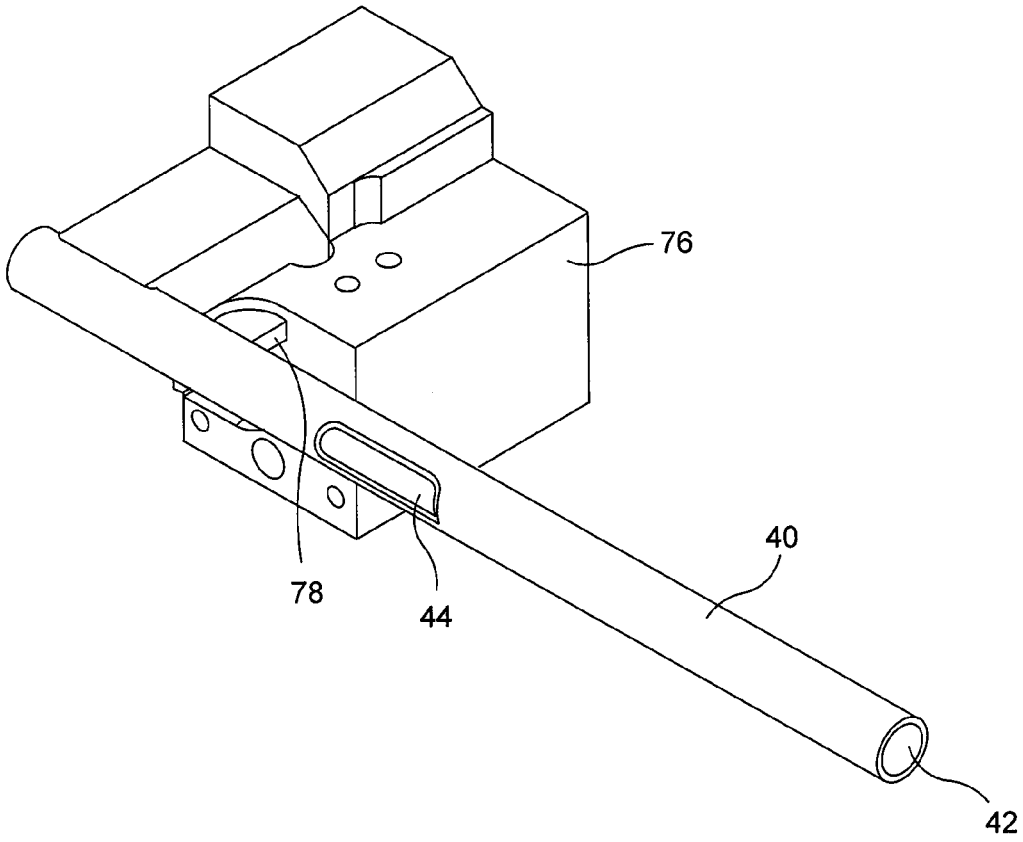
FIG. 3*c* is a perspective view of a blade member and inflation nozzle according to the embodiment of FIG. 3*a;*

FIG. 3*c* illustrates the removable blade member 76 and the inflation nozzle 40, and shows the nozzle 40 having an inflation hole 42 at one end, and a side inflation hole 44. The removable blade member 76 having cutting edge 78 is placed near the side inflation hole 44, such that the web is cut immediately after the inflation of the web, prior to sealing the web.

Figure 3D:
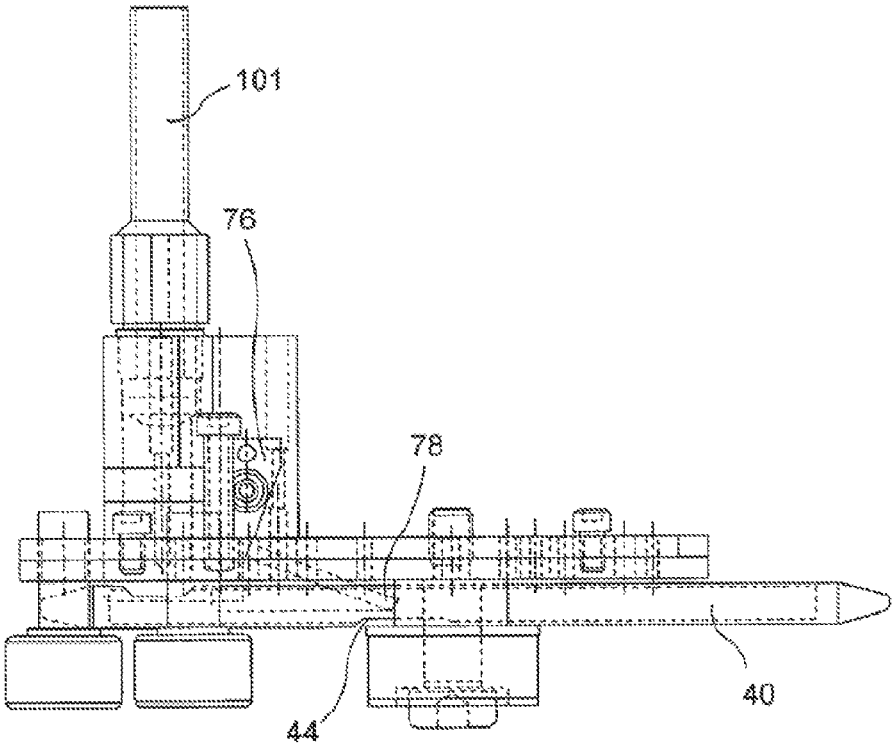
FIG. 3*d* is a top view of a blade member and inflation nozzle according to the embodiment of FIG. 3*a;*

In the embodiment shown in FIG. 3*d*, the removable blade member can provide the cutting edge 78 along a slit of the nozzle 40, so that a portion of the cutting edge is inside the nozzle 40. The cutting edge 78 of the removable blade member 76 can be placed such that the cutting of the web takes place immediately after the inflation of the web. As seen in the embodiment of FIG. 3*d*, the cutting edge 78 can be places such that a portion of the cutting edge 78 is longitudinally at the an end of the side inflation hole 44, preferably on the opposite transverse side of the nozzle 40 therefrom (although other angular orientations can be used), such that cutting takes place during the latter part of the inflation of the web, i.e., when being inflated by side inflation hole 44. Of course, the location of the cutting edge 78 can be moved around the nozzle such that the cutting takes place even before, during or after being inflated by the side inflation hole 44, as would be understood by one of ordinary skill in the art.

As seen in FIGS. 3*a* and 3*d*, for example, sealing/advancement mechanism can pinch opposing layers of the film together at a pinch location beginning at rollers 47 and 49 or 43 and 45, depending on the embodiment, for heat sealing the layers. The cutting mechanism is spaced upstream from the pinch location such that a portion of the web is substantially unsupported on an exterior side thereof between the cutting location of the blade 78 and the pinch location.

Figure 3E:
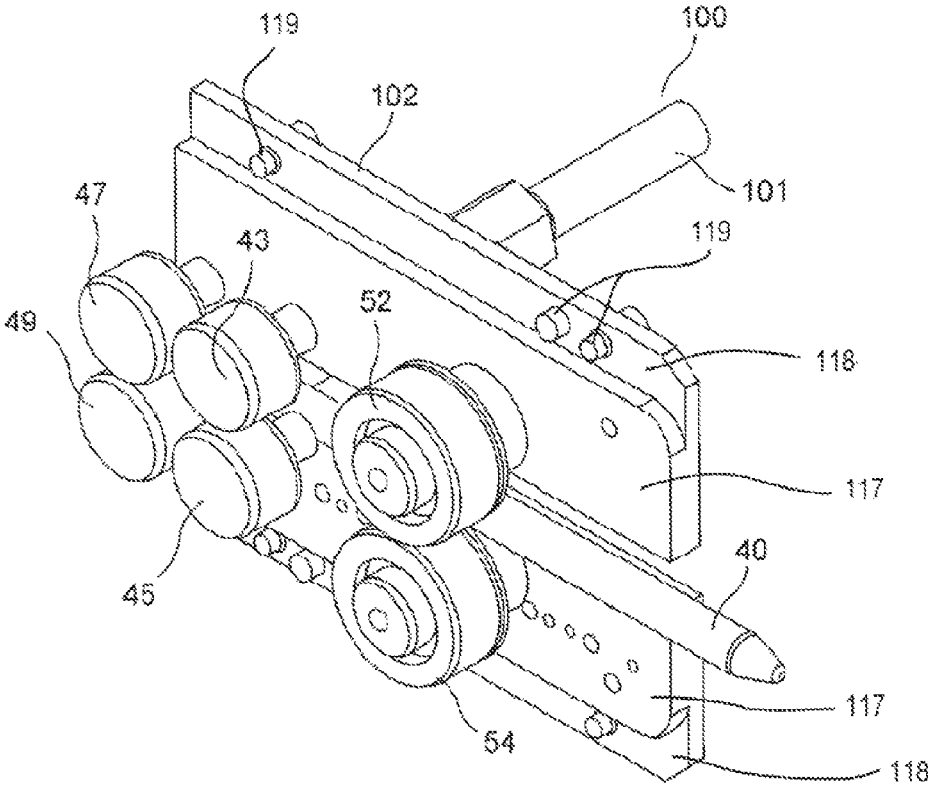
FIG. 3*e* is a perspective view of a module including the blade member and inflation nozzle according to the embodiment of FIG. 3*a;*

FIG. 3*e* shows a removable module 100 that includes a mounting plate 102, the hose 101, the inflation nozzle 40, the removable blade member 76, top insertion idler roller 52, bottom insertion idler roller 54, top cam rollers 43, 47 and bottom cam rollers 45, 49. As shown in FIG. 3*e*, the mounting plate 102 includes a surface 118 having alignment features 119. Plate 102 includes a second surface 117 that is offset from surface 118. The alignment features 119 correspond to and align with features 116 shown in FIG. 3*a*. Such a module can be removable and be placed in various machines 34, as provided in FIG. 3*a*. This allows quick and easy installation of the various embodiments described into ex1stmg dunnage machines, without the need for a replacement of the entire machine. Thus, only the cutting and inflation portions would be replaced in the machine 34, using the other existing parts of the machine.

Figure 4B:
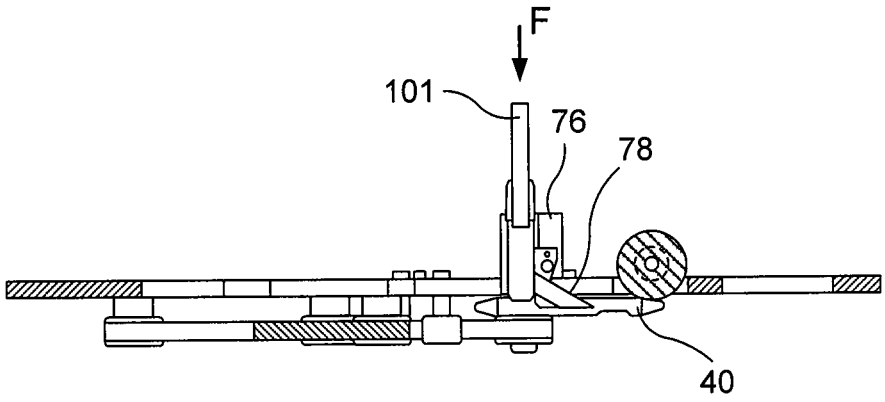
FIG. 4*b* is a top view taken along line B'-B' of the pillow inflating and sealing mechanism according to the embodiment of FIG. 4*a;*
Figure 4A:
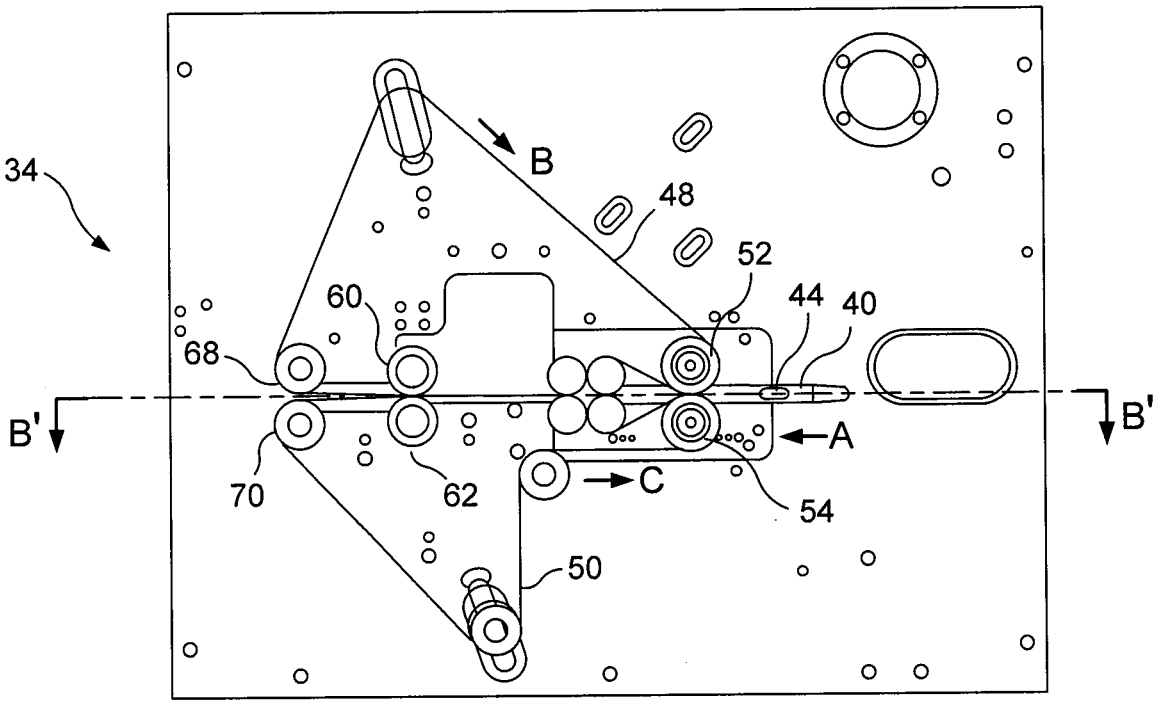
FIG. 4*a* is a side view of a pillow inflating and sealing machine according to another embodiment.

FIG. 4*a* describes another embodiment of a pillow inflating and sealing machine 34. FIG. 4*a* is similar to the embodiment of FIG. 3*a*, except that the length of the nozzle 40 is shorter. By shortening the nozzle, there can be certain advantages such as a decrease in the pressure required within the inflation mechanism using the same inflation rate, and a less powerful pump can be used. Further, the embodiment of FIG. 4*a* differs from that of FIG. 3*a* in that the side inflation hole 44 is located in a location such that the web material passes over the side inflation hole before the web goes past the top insertion idler roller 52 and bottom insertion idler roller 54. Further, the web is cut by the removable blade member 46 before the web goes past the top insertion idler roller 52 and bottom insertion idler roller 54. Once the web goes past the top insertion idler roller 52 and bottom insertion idler roller 54, it is then moved past the cam rollers 43, 45, 47 and 49, and to heat sealing element 66, similar to the embodiment described in FIG. 3*a*.

Figure 4C:
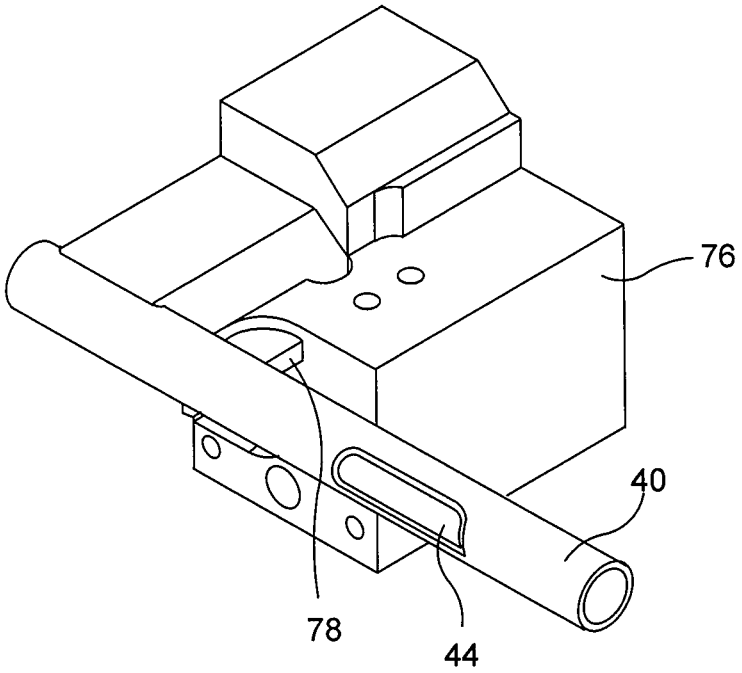
FIG. 4*c* is a perspective view of a blade member and inflation nozzle according to the embodiment of FIG. 4*a;*
Figure 4D:
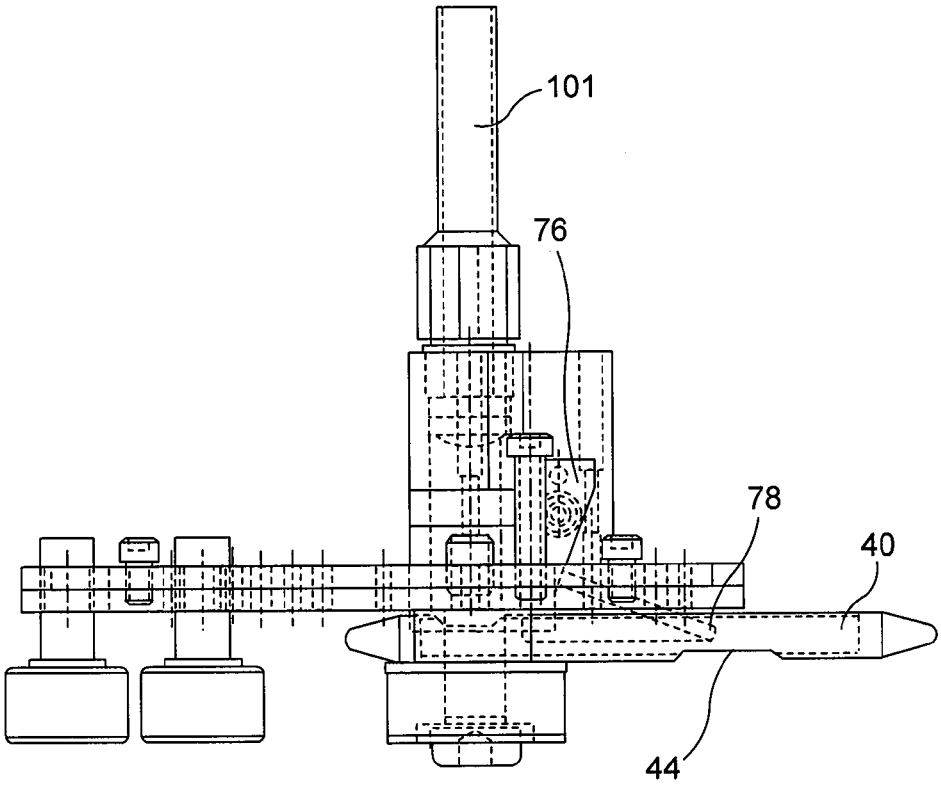
FIG. 4*d* is a top view of a blade member and inflation nozzle according to the embodiment of FIG. 4*a;*
Figure 4E:
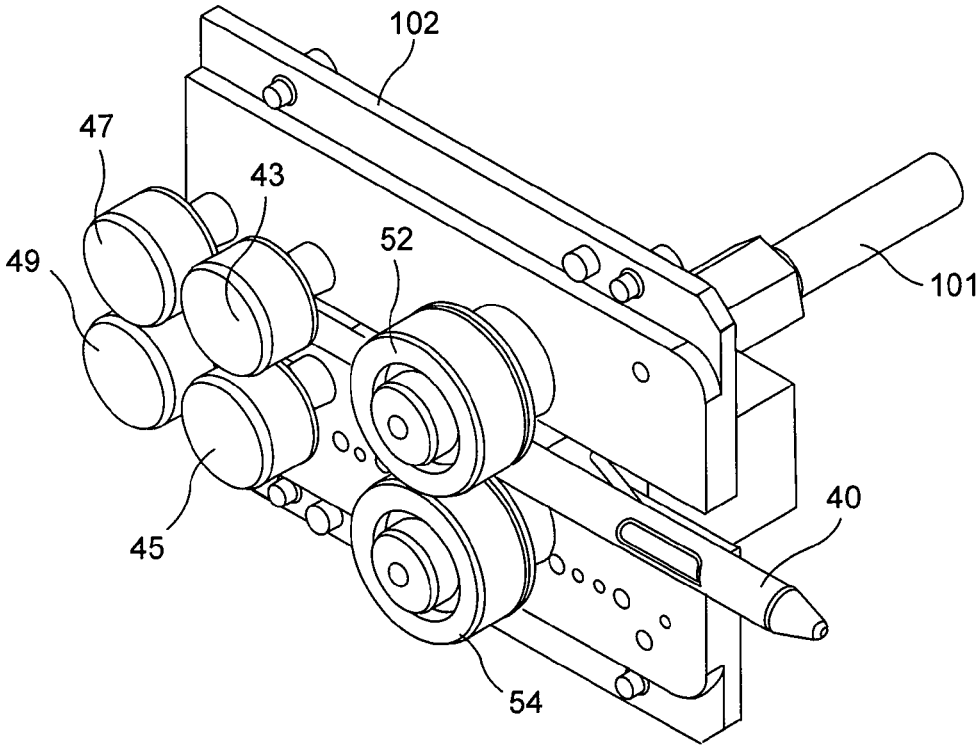
FIG. 4*e* is a perspective view of a module including the blade member and inflation nozzle according to the embodiment of FIG. 4*a;*

FIGS. 4*c*, 4*d*, 4*e* are similar to the embodiments described in FIGS. 3*d*, 3*d* and 3*e*, except that the length of the nozzle is shorter, and for the reasons as described above. The cutting blade 78 may be placed inside a slit in the nozzle 40, as shown in FIG. 4*d*, to cut the web as it passes over the nozzle 40 and past side inflation hole 44, similar to as described above with respect to FIG. 3*d*.

Figure 5B:
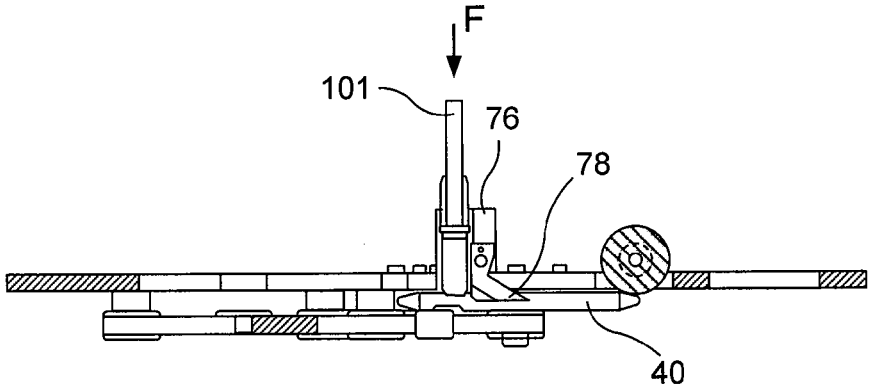
FIG. 5*b* is a top view taken along line C'-C' of the pillow inflating and sealing mechanism according to the embodiment of FIG. 5*a;*
Figure 5A:
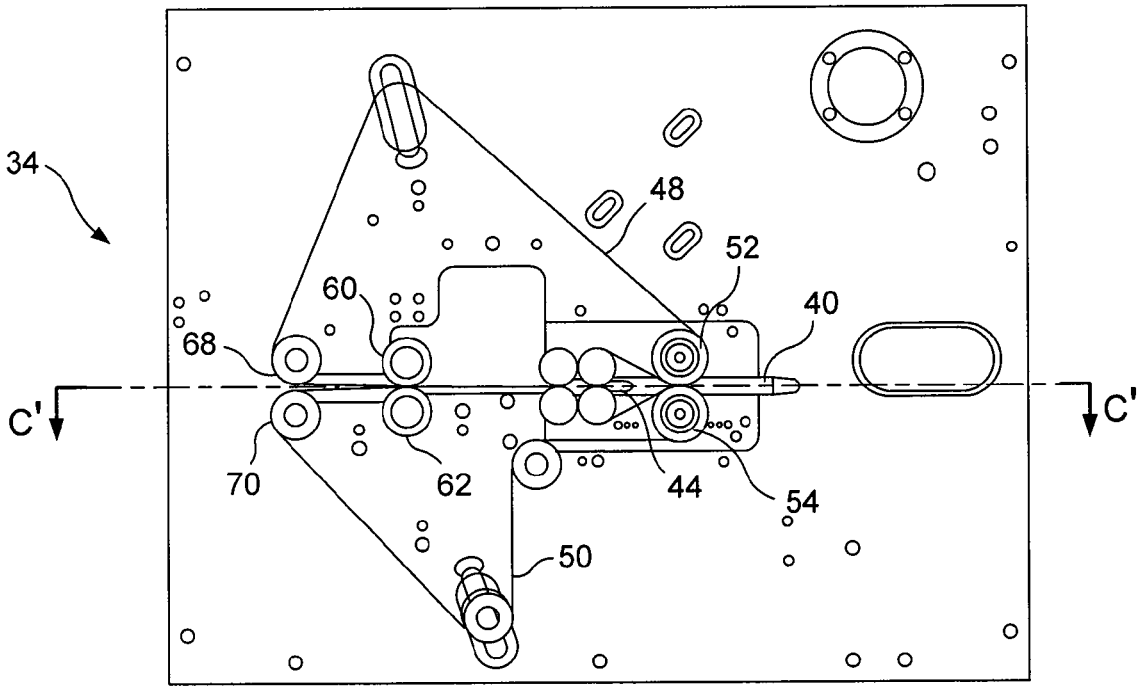
FIG. 5*a* is a side view of a pillow inflating and sealing machine according to another embodiment.

FIG. 5*a* describes an alternative embodiment of a pillow inflating and sealing machine 34. In operation, the machine 34 is similar to the one described above with respect to FIG. 3*a*. However, in this embodiment, the cutting of the web is performed prior to the inflation along the nozzle 40.

Figure 5C:
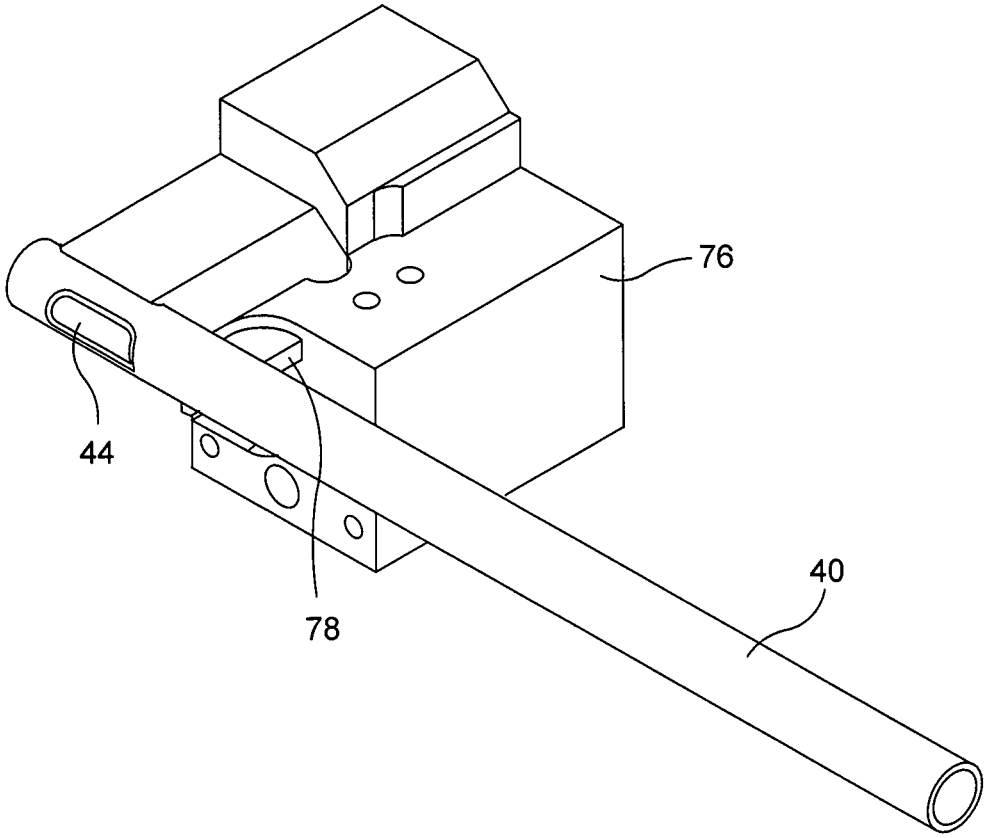
FIG. 5*c* is a perspective view of a blade member and inflation nozzle according to the embodiment of FIG. 5*a;*
Figure 5D:
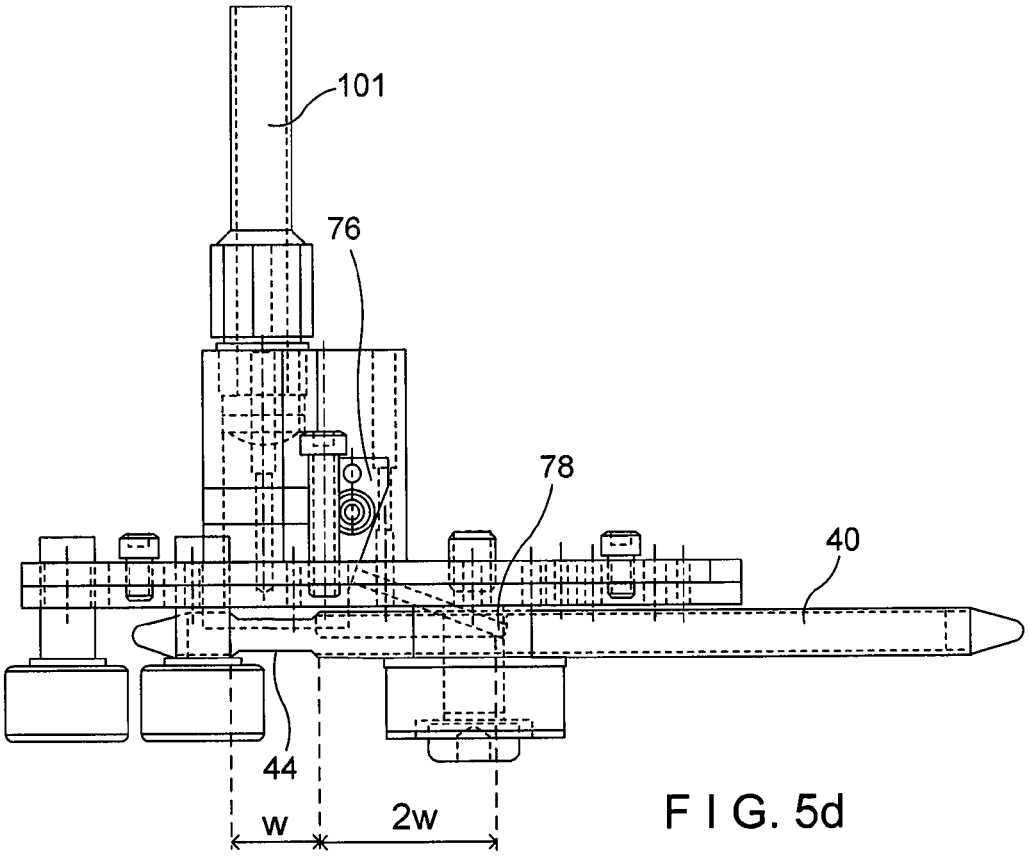
FIG. 5*d* is a top view of a blade member and inflation nozzle according to the embodiment of FIG. 5*a;*

As seen more clearly in FIGS. 5*c* and 5*d*, the removable blade member 76 is placed longitudinally upstream of the side inflation hole 44, so that the web material will pass over the cutting edge 78 before passing over the side inflation hole 44. This allows the web material to be cut prior to passing over the side inflation hole 44. As shown in FIG. 5*d*, the cutting edge 78 is in a location upstream of the side inflation hole, so that the web material is cut prior to being inflated along side inflation hole 44 of the nozzle 40.

Further, pressurized air from hose 101 is provided in a straight direction F so that the pressurized air can go directly in a substantially linear path into side inflation hole 44. The inlet into the nozzle 40 from the hose 101 is preferably disposed at the same, or at an overlapping longitudinal location as the side inflation hole 44, and is preferably aligned coaxially therewith, although in some embodiments, the inlet and inflation hole 44 can be disposed at different angular orientations about the longitudinal axis of the nozzle 40. The inlet is preferably the inlet into the elongated body of the nozzle 40, such as the cylindrical body thereof that is shown.

The distance between the side inflation hole and the edge of the blade member 78 can be preferably within about twice the distance (e.g., 2 w) of the width w of the side inflation hole 44. Of course, it would be understood by one of ordinary skill in the art that such distance could be equal to, less than or greater than the longitudinal width of the side inflation hole, and this is just one embodiment and not limited to such. Further, the location of the blade can be movable such that the cutting edge 78 is placed further upstream, or even downstream, of the location shown in FIG. 5*d*. In this embodiment, the location of the cutting edge 78 is such that the cutting of the web material is done prior to the web being inflated by the side inflation hole, but of course is not limited to such.

Figure 5E:
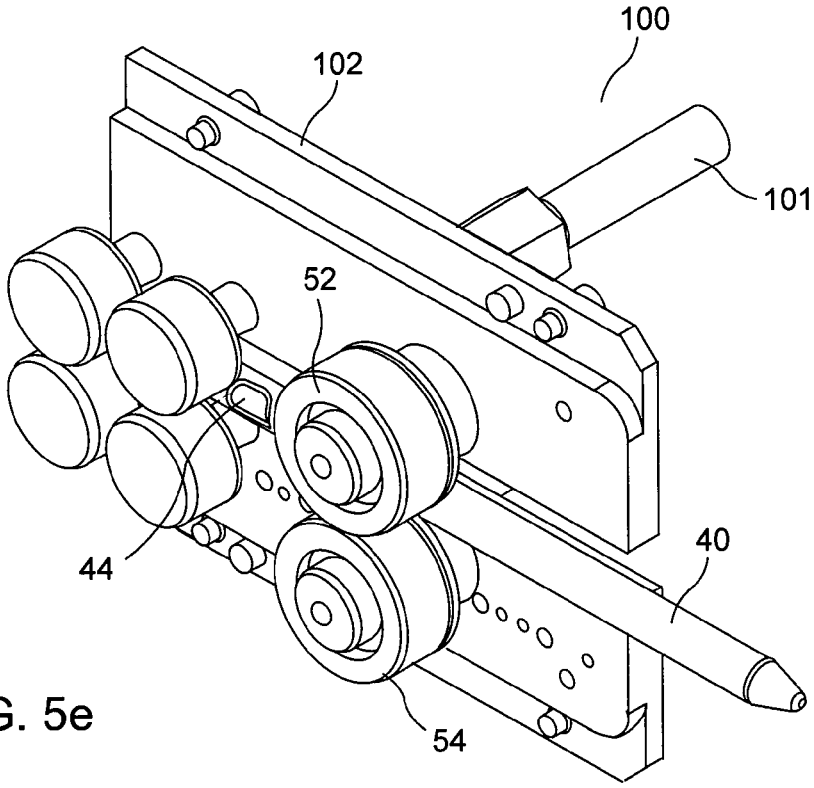
FIG. 5*e* is a perspective view of a module including the blade member and inflation nozzle according to the embodiment of FIG. 5*a;*

FIG. 5*e* shows the module 100 and is similar to the embodiment described with respect to FIG. 3*e*, except that the cutting of the web material is done prior to inflation by the side inflation hole 44.

Figure 6B:
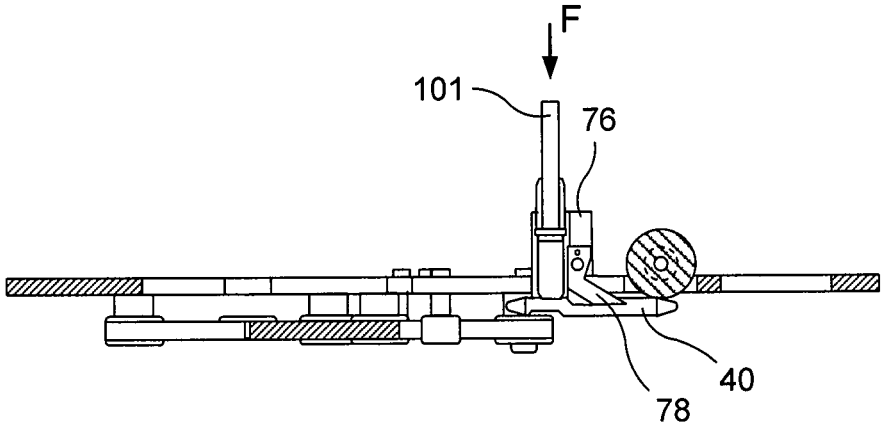
FIG. 6*b* is a top view taken along line D'-D' of the pillow inflating and sealing mechanism according to the embodiment of FIG. 6*a;*
Figure 6A:
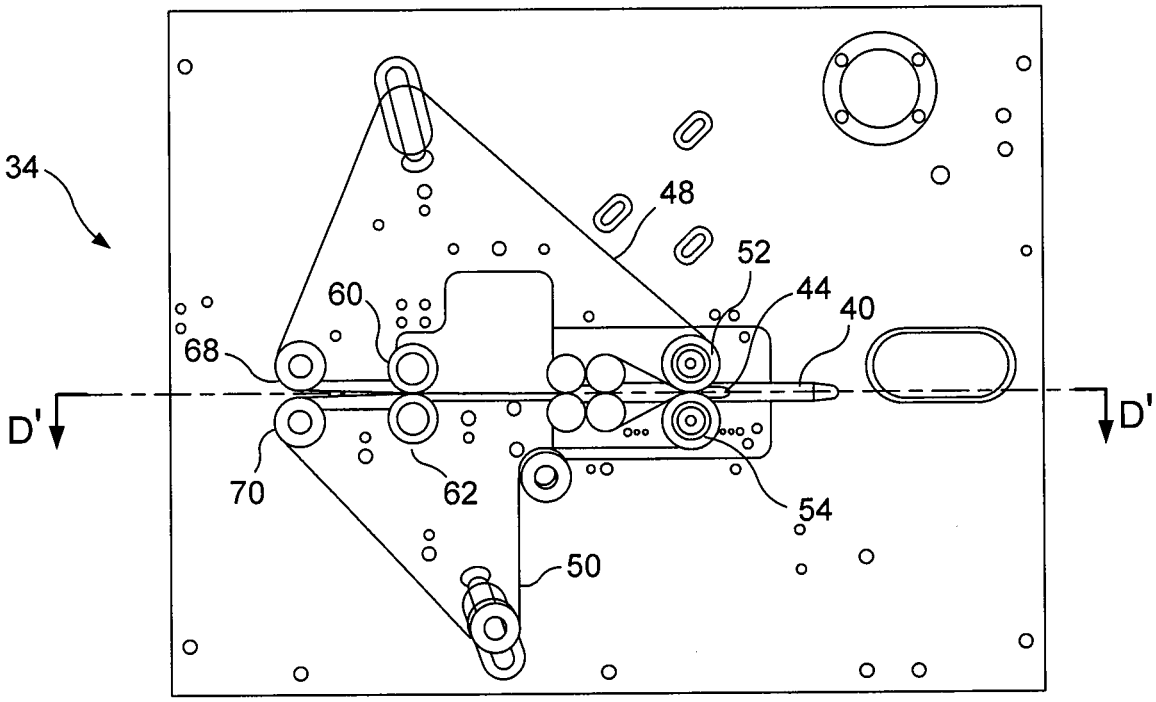
FIG. 6*a* is a side view of a pillow inflating and sealing machine according to another embodiment.

FIG. 6*a* describes another embodiment of a pillow inflating and sealing machine 34. FIG. 6*a* is similar to the embodiment of FIG. 5*a*, except that the length of the nozzle 40 is shorter. Further, the web is cut by the removable blade member 46 before the web goes past the top insertion idler roller 52 and bottom insertion idler roller 54. Further, the side inflation hole 44 is located in a location such that the web material passes over the side inflation hole before the web goes past the top insertion idler roller 52 and bottom insertion idler roller 54. Once the web goes past the top insertion idler roller 52 and bottom insertion idler roller 54, it is then moved past the cam rollers 43, 45, 47 and 49, and to heat sealing element 66, similar to the embodiment described in FIGS. 3*a* and 5*a*.

Figure 6C:
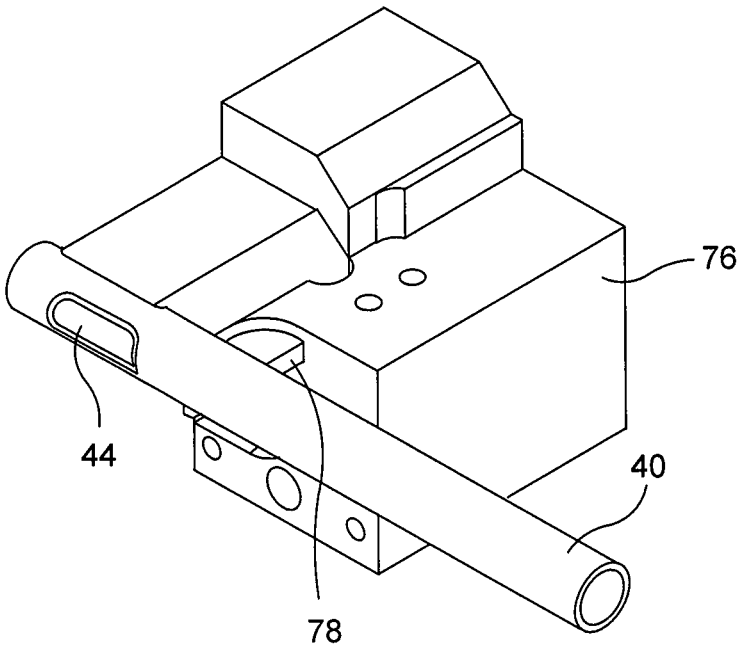
FIG. 6*c* is a perspective view of a blade member and inflation nozzle according to the embodiment of FIG. 6*a;*
Figure 6D:
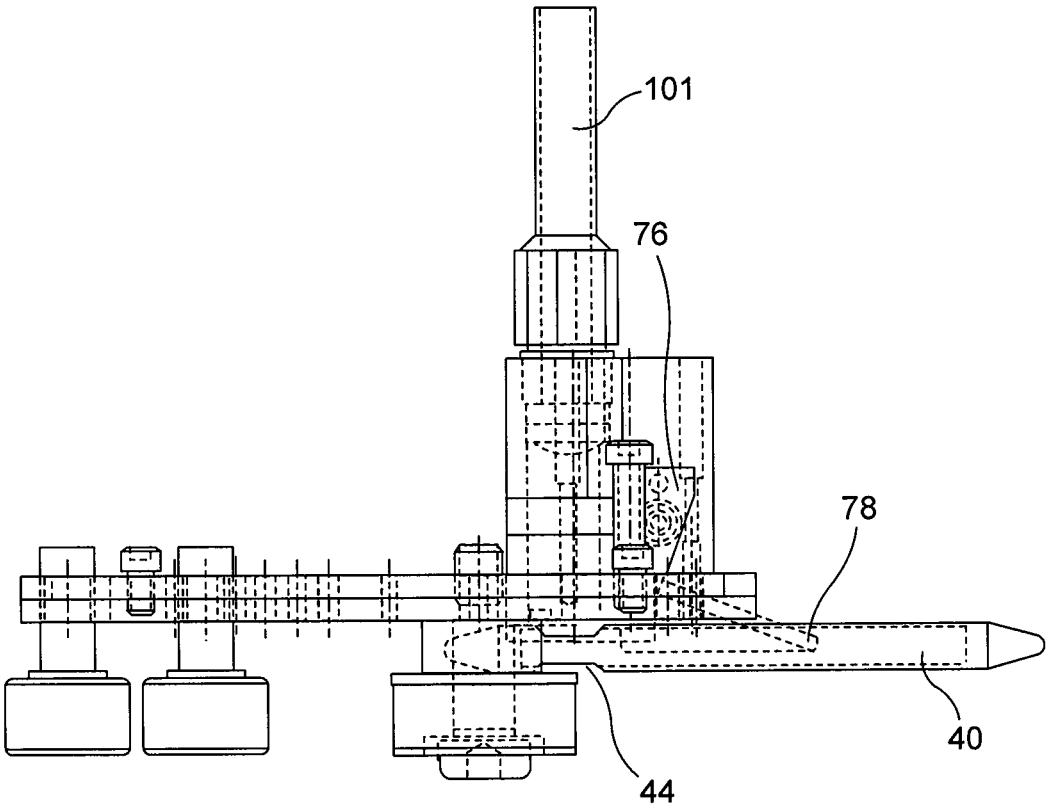
FIG. 6*d* is a top view of a blade member and inflation nozzle according to the embodiment of FIG. 6*a;*
Figure 6E:
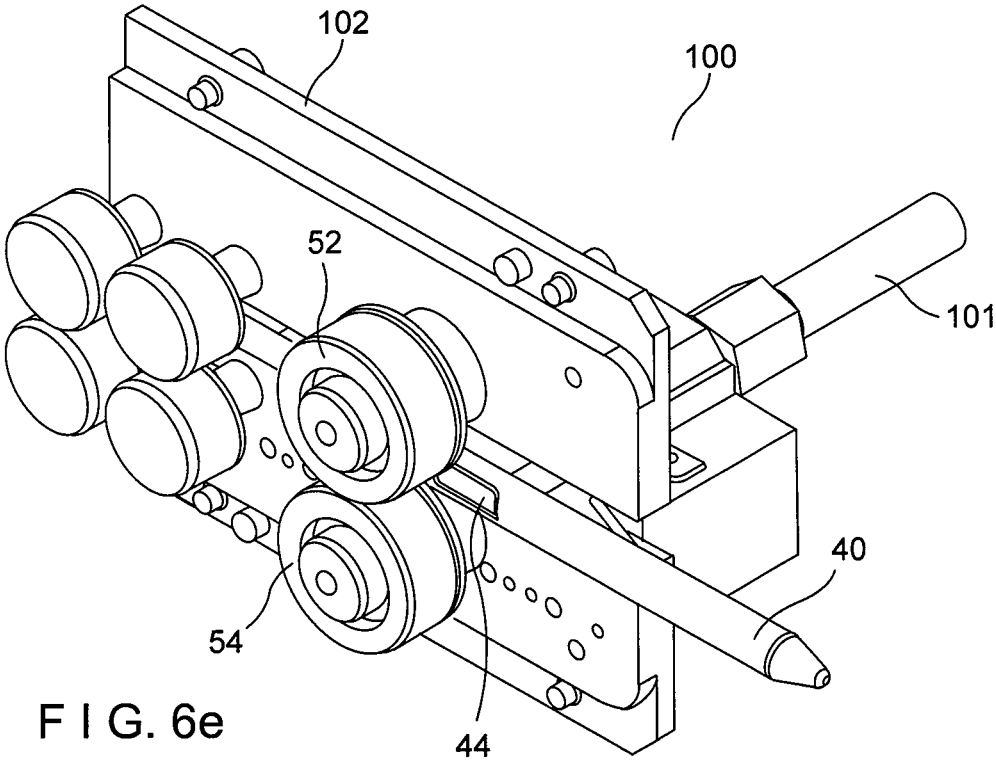
FIG. 6*e* is a perspective view of a module including the blade member and inflation nozzle according to the embodiment of FIG. 6*a;*

FIGS. 6*c*, 6*d*, 6*e* are similar to the embodiments described in FIGS. 5*d*, 5*d* and 5*e*, except that the length of the nozzle is shorter, and for the reasons as described above. The cutting blade 78 may be placed inside a slit in the nozzle 40, as shown in FIG. 6*d*, to cut the web as it passes over the nozzle 40 and before it passed the side inflation hole 44, similar to as described above with respect to FIG. 5*d*.

Figure 7:
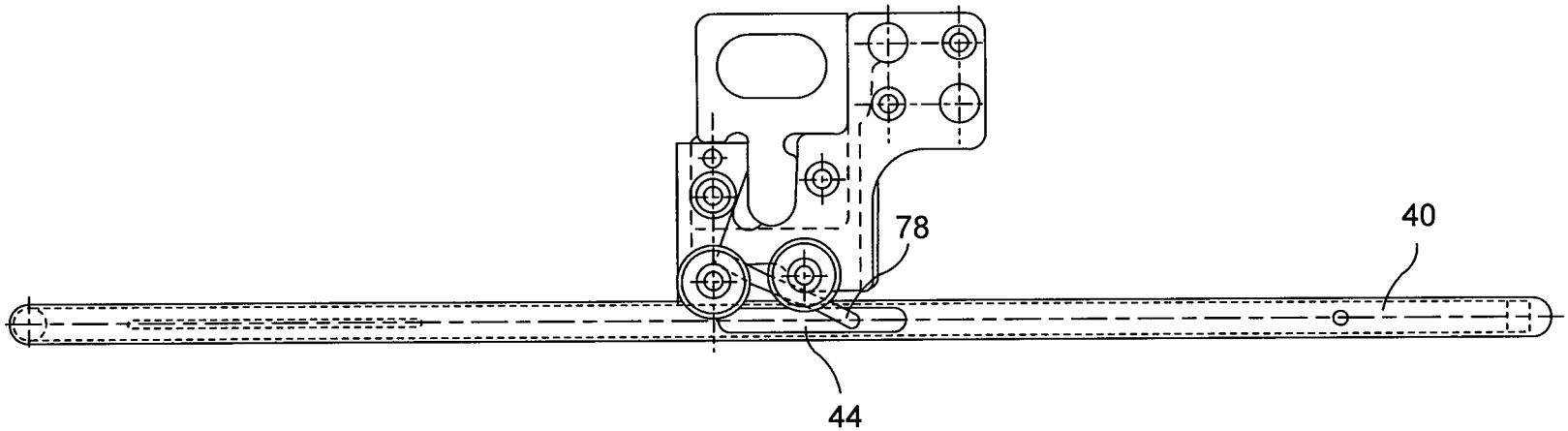
FIG. 7 is a side view of a blade member and inflation nozzle according to another embodiment.

In another embodiment as shown in FIG. 7, the cutting edge 78 of the removable blade member 76 can be in the same location as the side inflation hole 44 of the nozzle 40. Accordingly, the web material can be cut by the cutting edge 78 and inflated through the side inflation hole 44 at a same time. Further, the cutting edge 78 can be provided on a slit in the top of the nozzle 40 as shown in FIG. 7, or can even be provided along the side or bottom of the nozzle 40 in alternative embodiments, and is not limited to such.

Figure 8:
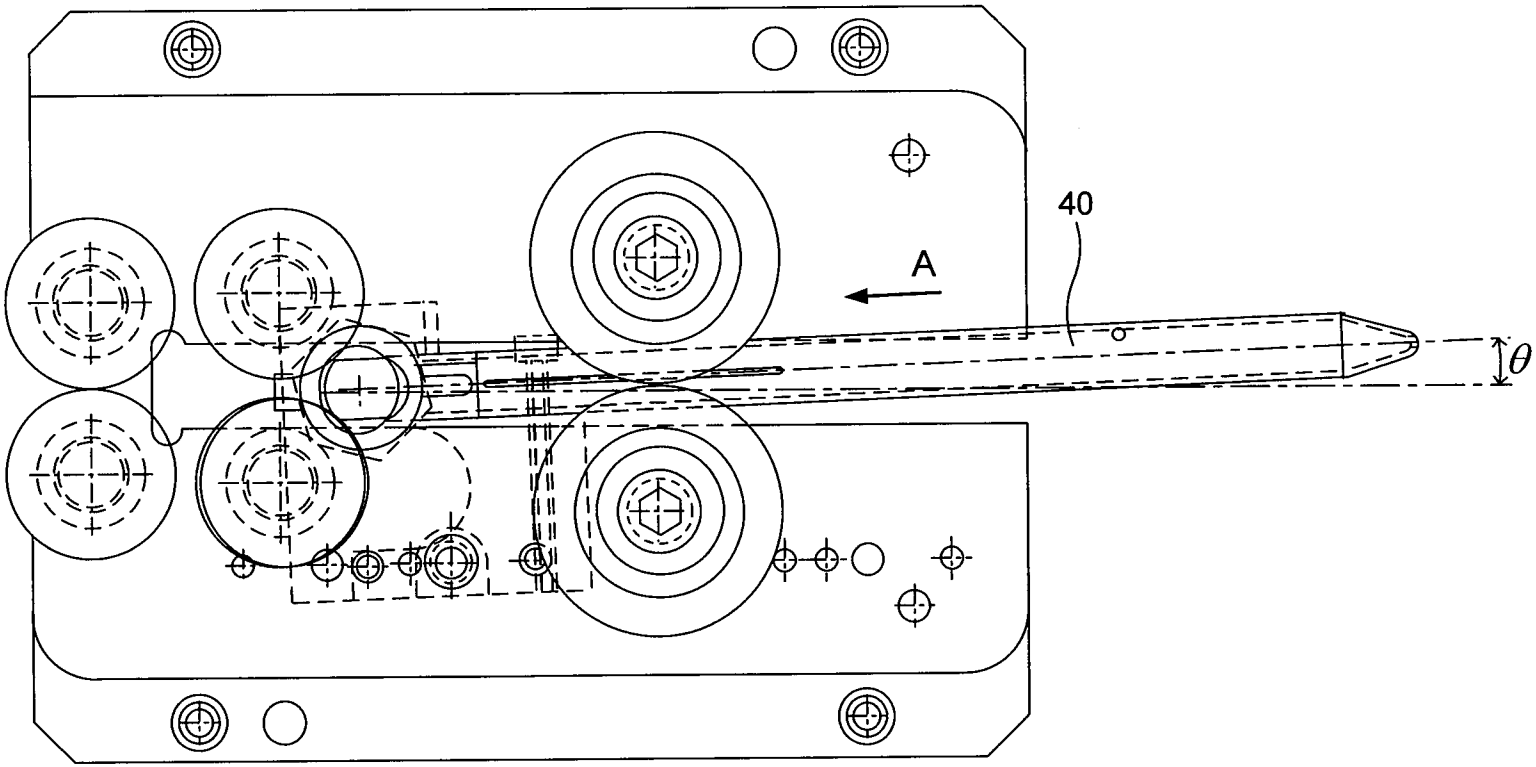
FIG. 8 is a side view of another embodiment of an inflation nozzle that can be angled.

FIG. 8 shows another embodiment of an inflation mechanism having an inflation nozzle 40, that can be provided at an angle θ with respect to the longitudinal path such that the material web would be provided on the inflation nozzle 40 at a downward angle as it advances along the direction A of the longitudinal path. The angled nozzle in this figure is preferably angled in a plane that is parallel to the longitudinal axis, and perpendicular to the transverse axis, so that the nozzle remains at about a right angle to the transverse axis. In some embodiments, the angle θ may be inclined in the transverse direction. Preferably, the angle θ is between about 1° and 5°, although other angles may be used. The entire nozzle, or preferably at least the guide portion thereof that is upstream of the inflation opening, can be angled with respect to the longitudinal axis, for example. The angle θ may be oriented parallel to the plane in which the rollers, belts, or other rotating members of the advancement mechanism (which may be combined with a sealing mechanism) are oriented.

Figure 9:
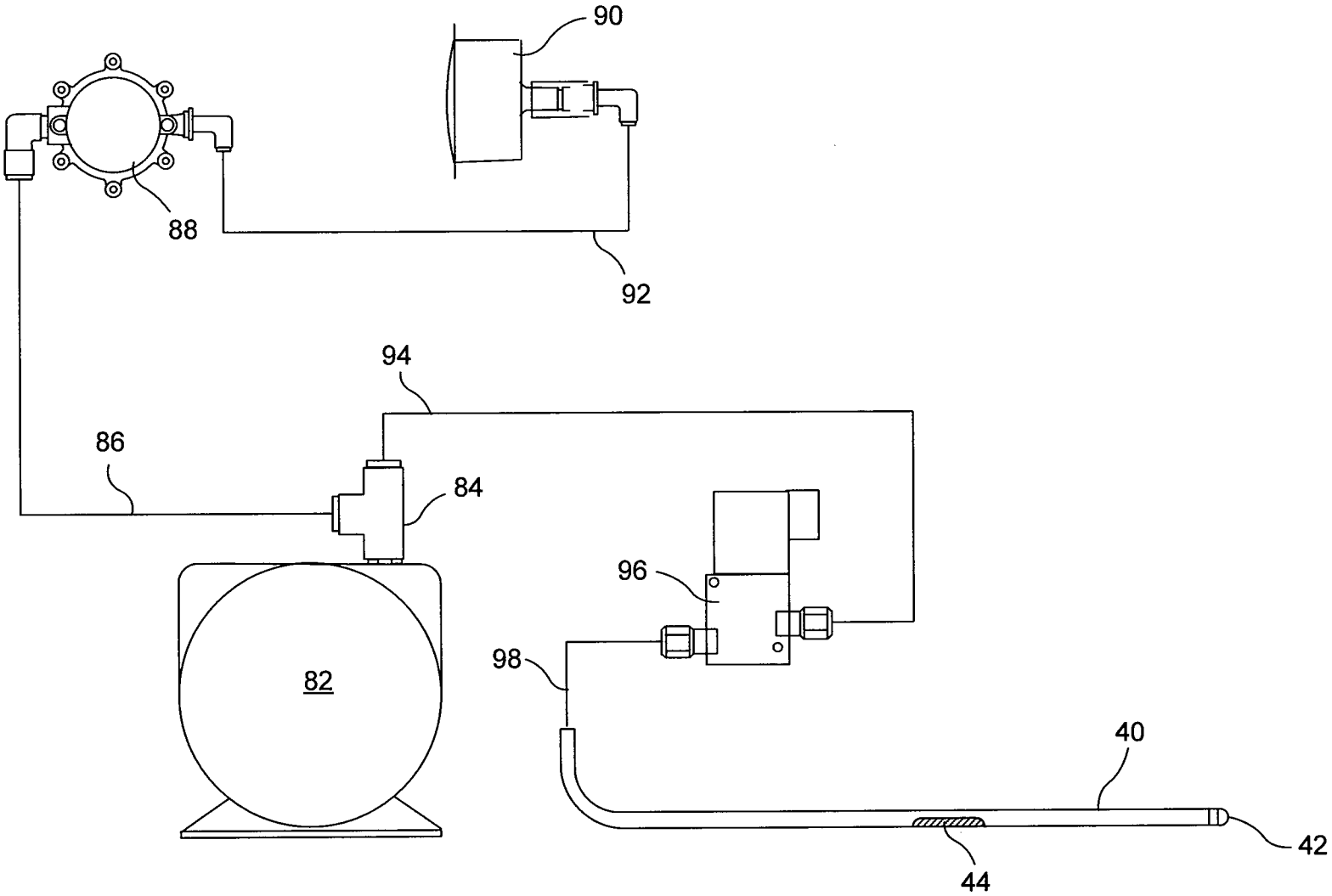
FIG. 9 is a schematic diagram of inflation gas flow according to an embodiment.

Inflation and sealing machines according to the present disclosure can incorporate several features that help to assure that reliable and intact pillows are consistently inflated and sealed in an efficient and economic manner. Turning now to FIG. 9, a schematic of the provisioning and direction of pressurized gas according to one embodiment of the present disclosure is shown. A gas source 82 is provided within or near a device to provide gas for inflation of the pillows 28. According to one embodiment of the present disclosure, the inflation gas is ambient air, and the gas source 82 is an air pump. Alternatively, the inflation gas may be any gas suitable for inflation and the gas source 82 may be a compressed gas canister, air accumulator, or other compressed gas source.

Gas from the gas source 82 can be input into a first coupler 84. A first gas line 86 exits the coupler and can be coupled to a pressure regulator 88, and then to a pressure gauge 90. According to one embodiment, the pressure regulator 88 is a relieving regulator that emits gas from the system. According to one embodiment, the first gas line 86 is a ⅜ inch tube, which narrows down to a ⅛ inch tube in a second portion 92 before being input into the pressure gauge 90.

A second gas line 94 can convey gas from the first coupler 84 to a directional valve 96. According to one embodiment, the directional valve 96 is a solenoid-activated directional valve. A second portion 98 of the second gas line 94 conveys gas into the inflation nozzle 40, where it exits through the side inflation hole 44 and is used to inflate packaging pillows. With this gas flow, the pressure gauge 90 measures the pressure in both gas lines, including the pressure in the pressure regulator 88 and the inflation nozzle 40. The pressure throughout the gas schematic shown in FIG. 9 can be substantially similar throughout the system, and may be considered a system pressure.

The gas flow shown in FIG. 9 allows for the conservation of material in devices and methods of the present disclosure, because the directional valve 96 allows for the pulsing of gas out of a pillow manufacturing machine during starting and stopping of the machine. For example, in the machine 34 shown in FIG. 3*a*, the first and second drive belts 48 and 50 travel slowly during startup of the machine as power is transferred to the driving nip rollers. As a result, the web 10 propagates very slowly through the machine 34 during startup. The gas source 82, however, is prepared to deliver a full load of gas to the slowly propagating web. If this full load of gas is delivered to the web, overinflation results, which may in turn result in weakened seals—because the overinflated pillow pulls away from the heat sealing element 66—or bursting pillows within the machine. To compensate, the directional valve 96 releases inflation gas during startup of the machine, thereby decreasing the pressure of gas provided into the second gas line 94, including the second portion 98, and into the inflation nozzle 40.

Similarly, when the machine is shut down, the web 10 is propagated more slowly as the driving nip rollers and belts 48 and 50 come to a stop. During the shutdown speed transition, the directional valve 96 is again pulsed as needed to assure that overinflation does not occur. According to one embodiment of the present disclosure, the duration and rate of pulses of the directional valve 96 is controlled by a programmable logic controller so that pulsing continues for a certain time during startup and shutdown. According to one embodiment of the present disclosure, the directional valve 96 can be opened approximately 9 times for 0.5 to 0.50 seconds per opening during the first three seconds during startup and during the last three seconds during shutdown. Alternatively, a variable speed blower could be used to control inflation during startup and shutdown. According to one embodiment, with an inflation machine operating at zero speed, from 90% to 100% of inflation gas is relieved, with an inflation machine operating at half speed approximately half of the inflation gas is relieved, and with an inflation machine operating at full speed, no inflation gas is relieved and the inflation nozzle receives substantially all of the inflation gas from the gas source 82.

The gas flow path of FIG. 9 also allows for operator control of the amount of gas being input into the web 10 to inflate pillows 28. The relieving pressure regulator 88 bleeds off excess gas to maintain a set system pressure. A pressure gauge 90 may be provided along the gas flow system to allow an operator to monitor and control the proper inflation pressure. Depending on the speed with which the web 10 is propagated and inflated using a device according to the present invention, the relieving pressure regulator 88 may be adapted to release gas at comparatively higher or lower pressures. Factors that influence the desired gas pressure include the desired pillow size and the desired inflation per pillow. For example, according to one embodiment of the present disclosure, the web is propagated through the machine 34 of FIG. 3*a* at a speed of approximately 50 feet per minute. At this speed, a pressure within the inflation nozzle 40 of between approximately one and five pounds per square inch is appropriate to inflate the gas pillows using the web shown in FIG. 1. Though the optimum pressure is dependent on the size of inflation openings and the desired rate of ejection of gas through the inflation openings, devices and methods according to the present disclosure using pressures from approximately 0.5 pounds per square inch and approximately 5.0 pounds per square inch are appropriate for some embodiments. According to some embodiments of the present disclosure, a programmable logic controller may be used to control system pressure.

Figure 10:
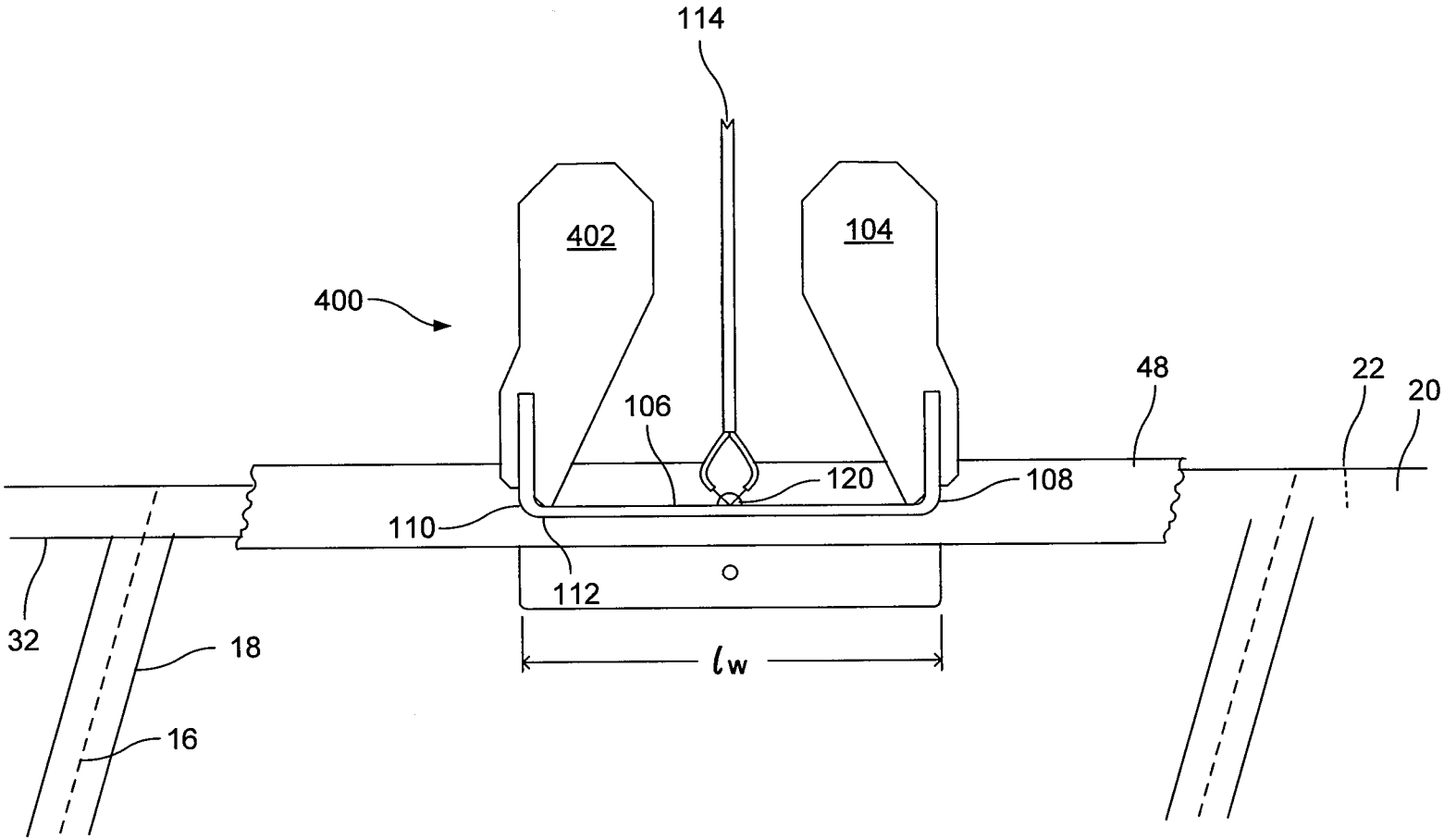
FIG. 10 is a side view of a sealing device according to an embodiment.

Devices and methods according to the present disclosure are capable of making reliable longitudinal seals in manufactured gas pillows. Turning now to FIG. 10, a heat sealing element 400 according to one embodiment of the present disclosure is shown. The heat sealing element 400 includes first and second mounting fins 402 and 104 holding a sealing wire 106 therebetween The sealing wire 106 contacts the first drive belt 48 and heats the first drive belt to a sufficient temperature in the vicinity of the sealing wire 106 to weld the top and bottom sheets 20 and 22 to each other, thereby forming a longitudinal seal 32. The sealing wire 106 may be heated by passing a current through the wire. In the embodiment shown in FIG. 10, the sealing wire 106 is provided with a first bent portion 108 where the sealing wire 106 first contacts the first drive belt 48 and a second bent portion 110 where the sealing wire 106 is removed from contact with the first drive belt 48. Other sealing wire mounting techniques may be used in alternative embodiments.

The sealing wire 106 contacts the first drive belt 48 along a contact surface 112. According to one embodiment of the present disclosure, the contact surface 112 has a length 1W of approximately 2 inches, and the sealing wire 106 comprises an 80-20 Nickel—Chromium alloy and has a cross-sectional area of approximately 0.003 in2. To minimize overheated hot spots along the length of the sealing wire 106, maximize the life of the first drive belt 48, and prevent or inhibit the need for frequent replacement of the drive belt 48, the areas of the first bent portion 108, second bent portion 110, and contact surface 112 of the sealing wire 106 where the sealing wire touches the belt 48 are manufactured, rounded, and provided with a smooth finish. According to one embodiment, the sealing wire 106 is straight within about 0.005 inch over a length of about two inches.

The sealing wire 106 is preferably maintained at a consistent sealing temperature so that heat is properly transferred through the belt 48 onto the web 10 to reliably weld the top sheet 20 to the bottom sheet 22. In one embodiment of the present disclosure, the web 10 is a polyethylene web, and the sealing wire 106 is kept at a temperature set point of approximately 420° F. The sealing temperature set point may be raised or lowered depending on such factors as the speed at which the machine 34 is operated, the material properties of the web 10, the ambient temperature conditions, the condition of the sealing wire 106, the condition and material properties of the belt 48, and the like. Temperatures of from about 300° F. to about 600° F. are preferred in some embodiments, though even wider temperature ranges may be called for in certain embodiments.

According to some embodiments of the present disclosure, a closed-loop temperature control is employed to maintain the sealing wire 106 at an optimal sealing temperature. A thermocouple 114 may be used to sense the temperature of the sealing wire 106. According to one embodiment of the present disclosure, with the sealing wire 106 being a nickel-chromium sealing wire, a nickel-bearing silver alloy connection 120 is provided between the thermocouple 114 and the sealing wire 106, with a small amount of brazing used to secure the connection 120 to the sealing wire 106. The thermocouple allows accurate measurement of the temperature of the sealing wire 106 when the thermocouple 114 is connected to a temperature control module. The closed loop feedback provided by the thermocouple 114 allows the temperature control module to maintain the sealing wire temperature within an exact range. This temperature control is possible even when changing factors would cause the temperature of the sealing wire 106 to drift. Such factors may include poor contact between the mounting fins 402 and 104 and the sealing wire 106 resulting in poor current transmission to the sealing wire 106, the replacement of the sealing wire 106 with a new sealing wire having a difference in resistance, the pressure of the sealing wire 106 against the belt, the blend of film used in the web 10, and the condition and thickness of the belt 48. According to some embodiments of the present disclosure, the temperature of the sealing wire 106 is maintained within about ±3° F. of a selected sealing temperature, though higher or lower tolerances are used according to some embodiments. In some embodiments of the present disclosure, sensors such as an infrared non-contact temperature sensor or a current detecting sensor may be used to gather temperature information regarding the sealing wire 106.

Figure 11:
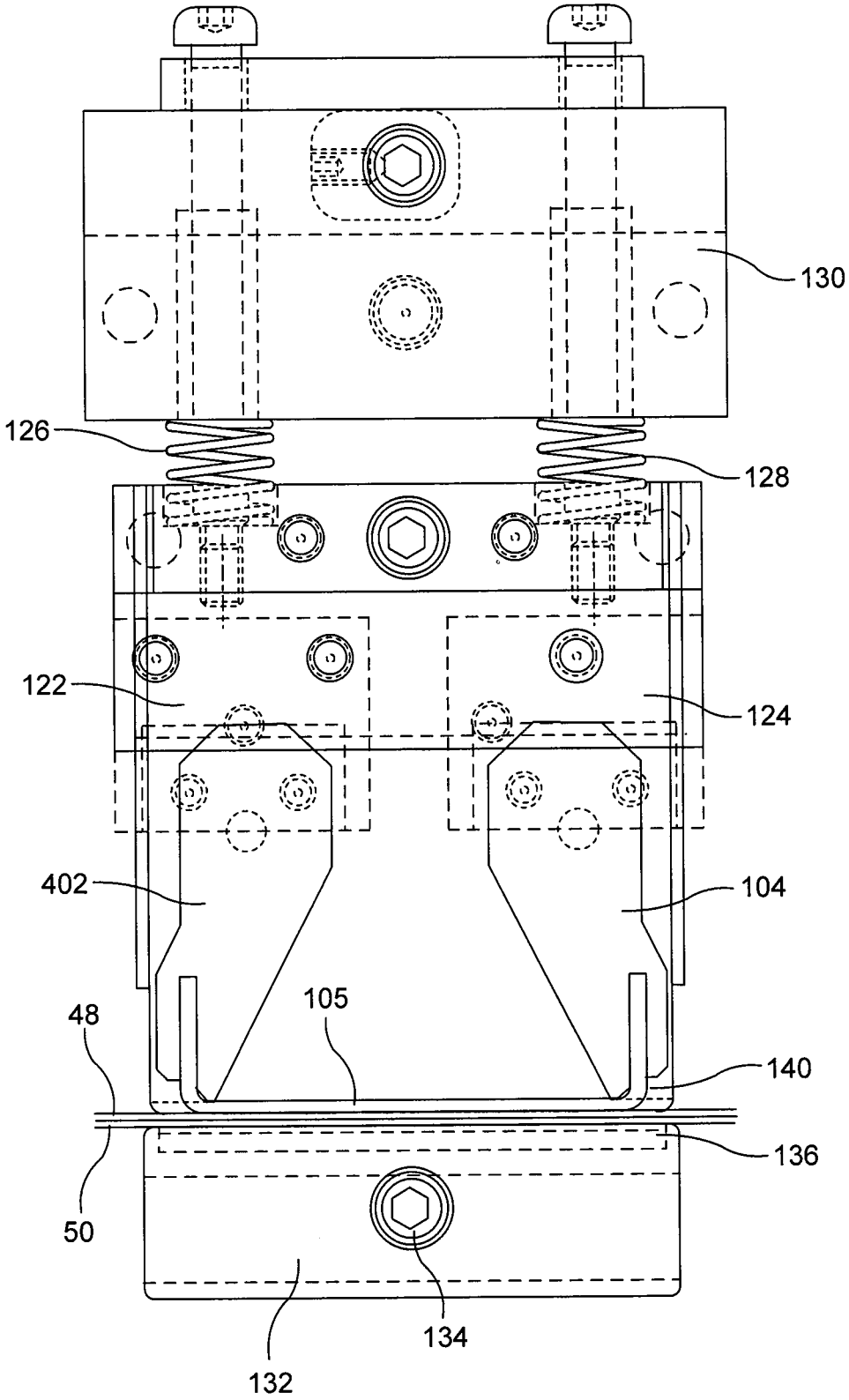
FIG. 11 is another side view of a sealing device according to an embodiment.

Turning now to FIG. 11, a side view of the heat sealing wire 106 and its surrounding structure is shown. The first and second mounting fins 402 and 104 are mounted to first and second mounting blocks 122 and 124. Downward pressure is maintained on the first and second mounting blocks 122 and 124 by first and second compression springs 126 and 128, which are provided between the first and second mounting blocks 122 and 124 and a top mounting block 130. The top mounting block 130 may be directly mounted to the mounting plate 64, as shown in FIG. 3*a*. This construction allows the sealing wire 106 to maintain reliable contact with the first drive belt 48.

According to some embodiments of the present disclosure, the sealing wire 106 is unsupported along its length as it contacts the first drive belt 48. To avoid bending of the sealing wire 106 and to maintain contact between the sealing wire and the first drive belt 48—and thus maximize the transmission of thermal energy from the sealing wire 106 to the web 104—a sealing support platen 132 is provided beneath the second drive belt 50 in the heat sealing area. Thus, the first drive belt 48, the web 10, and the second drive belt 50 are interposed between the sealing wire 106 and the sealing support platen 132. According to one embodiment of the disclosure, the sealing support platen 132 is provided with a platen pivot 134 about which the platen is free to rotate. Thus, the sealing support platen 132 is self-aligning with the sealing wire 106, maintaining more complete contact between the first drive belt 48 and the sealing wire 106 along the contact surface 112 of the sealing wire. According to some embodiments, the sealing wire 106 may be supported along its length, for example by a thermocouple.

According to some embodiments of the present disclosure, to maintain a more complete contact between the first drive belt 48 and the sealing wire 106 along the contact surface 112, a top surface 136 of the sealing support platen 132 is resilient, with the body of the platen 132 being aluminum or another suitable material. Resilient material along the top of the sealing support platen 132 allows for even pressure across the sealing wire regardless of imperfections in the straightness of the sealing wire. A resilient surface may be provided with a multi-layer surface construction comprising a base layer of silicone high-temperature adhesive to provide adhesion between the resilient layers and the support platen 132, a second layer of silicone having a durometer of 30 as measured on a "Shore A" machine, and a top layer of resilient tape. According to one embodiments, the top resilient layer is DURIT® tape manufactured by Toss Manufacturing company.

Figure 12:
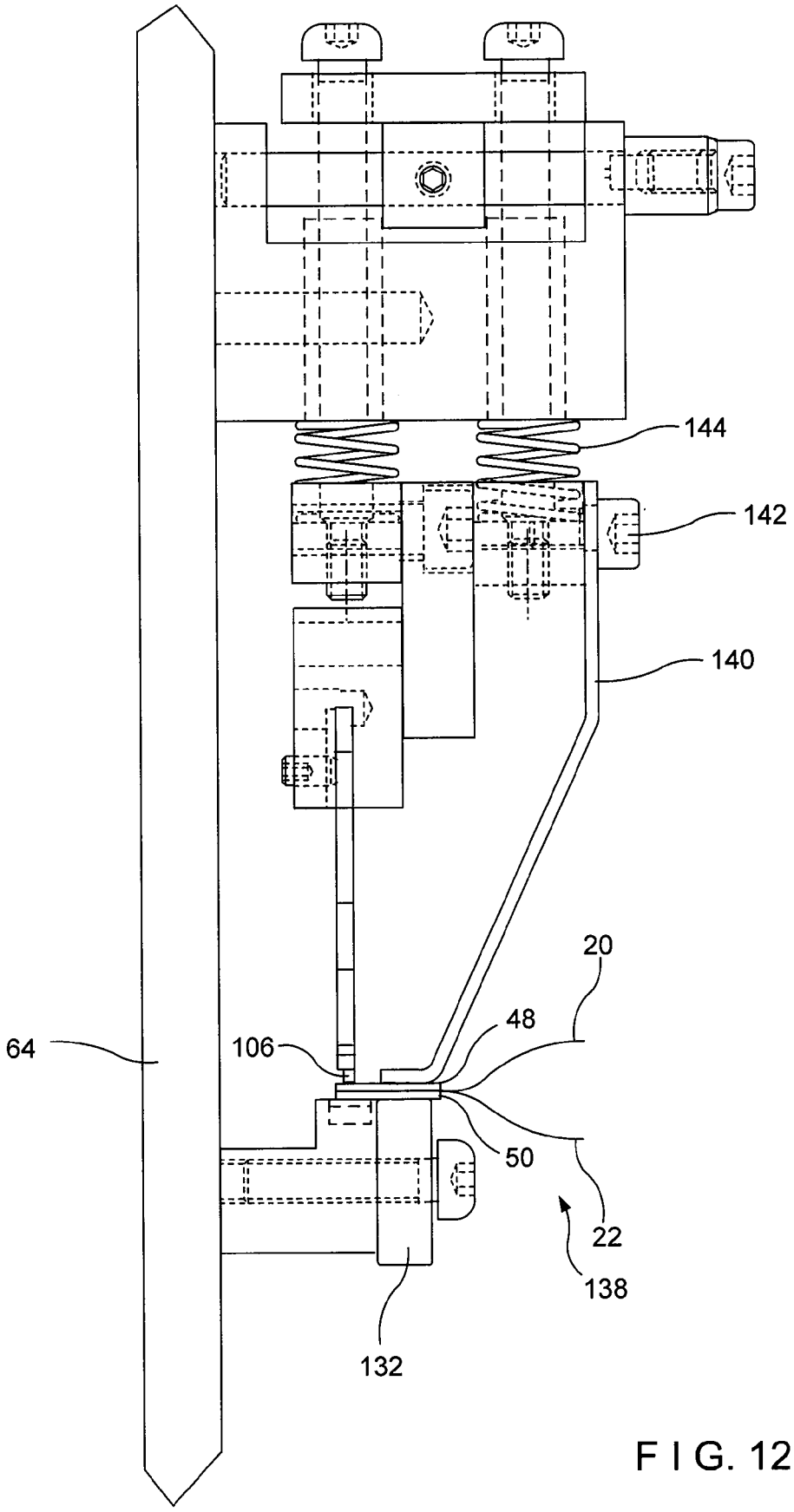
FIG. 12 is an end view of a sealing and clamping mechanism according to an embodiment.
Figure 13:
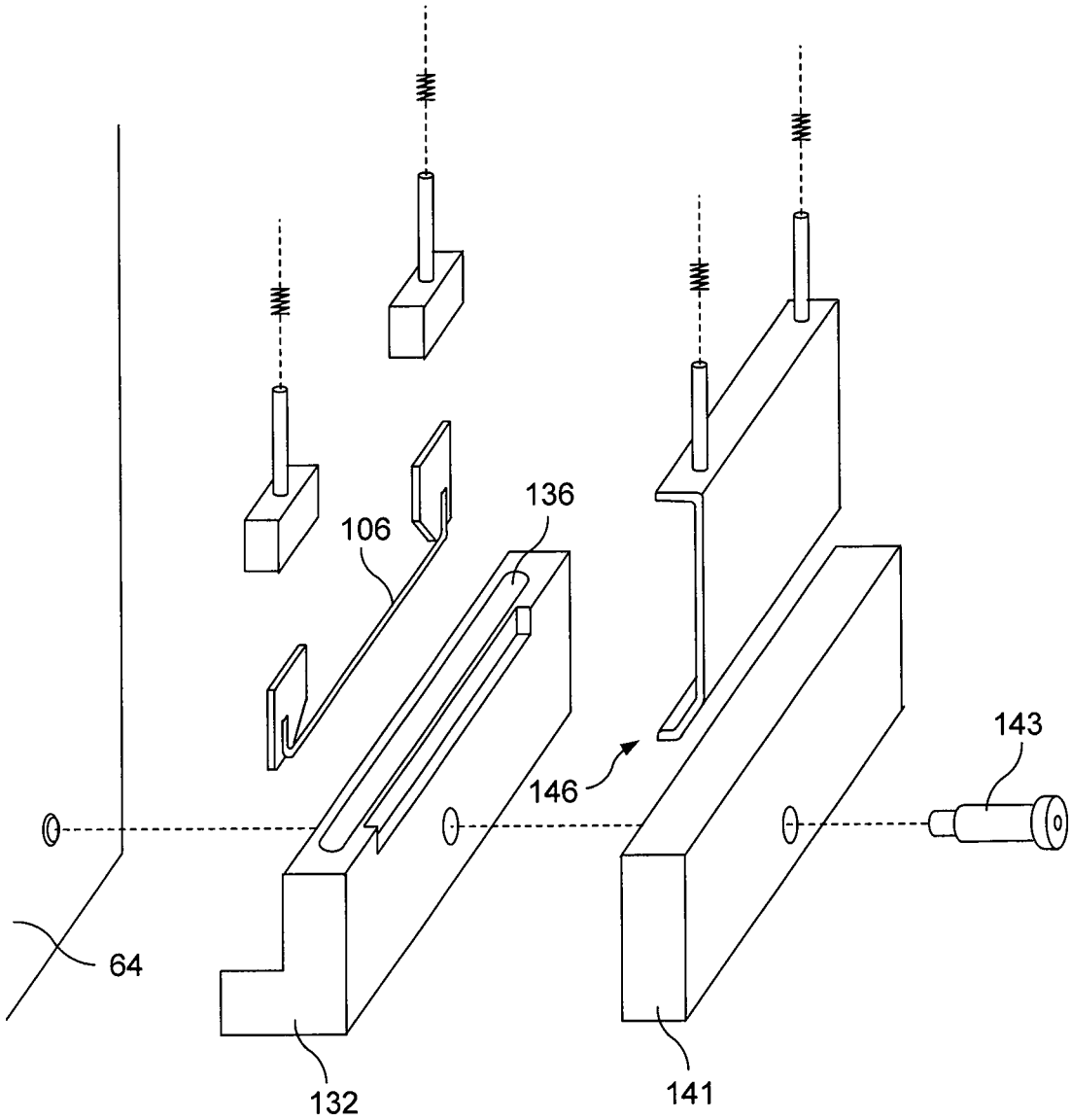
FIG. 13 is an exploded view of a clamping and sealing mechanism according to an embodiment.

Although the web 10 is held between two drive belts as well as between the sealing wire 106 and the sealing support platen 132 in the area of sealing, the inflated pillows result in the top sheet of the web 20 separating from the bottom sheet of the web 22, which in turn tends to draw the inflated pillows away from the sealing wire, in an outward direction from the mounting plate 64. This formation is more clearly illustrated in FIG. 12, which is an end view of a sealing area sealing an inflated pillow 138 according to one embodiment of the present disclosure. To maintain the top sheet of the web 20 in contact with the bottom sheet of the web 22 in the sealing area, a sealing clamp 140 is provided along the distance of the sealing wire 106. The sealing clamp is biased against the first drive belt 48 similarly to the sealing wire 106. The sealing clamp is mounted in a sealing clamp mount, which uses sealing clamp compression springs 144 to maintain a downward pressure on the sealing clamp 140, such that a clamp contact surface 146 maintains an even force keeping the belts 48 and 50, as well as the top and bottom sheets 20 and 22 of the inflated pillow 138, pressed against each other in the sealing area. In the embodiment of FIG. 12, both the sealing wire 106 and the sealing clamp 140 are biased against separate platens, with the sealing wire 106 located closer to the mounting plate 64 than the sealing clamp 140. Alternatively, one platen may be used to support both the sealing wire 106 and the sealing clamp 140. The relationship between the sealing wire 106 and the sealing clamp 140 is also shown in FIG. 13, which shows both the sealing wire 106 and the contact surface 146 of the sealing clamp 140 in relation to the sealing support platen and a clamp support 141. A pivot shoulder screw 143 may be used to connect the sealing support platen 132 and the clamp support 141 to the mounting plate 64, allowing supports to pivot and self-align with the sealing wire 106 and the sealing clamp 140.

Figure 14:
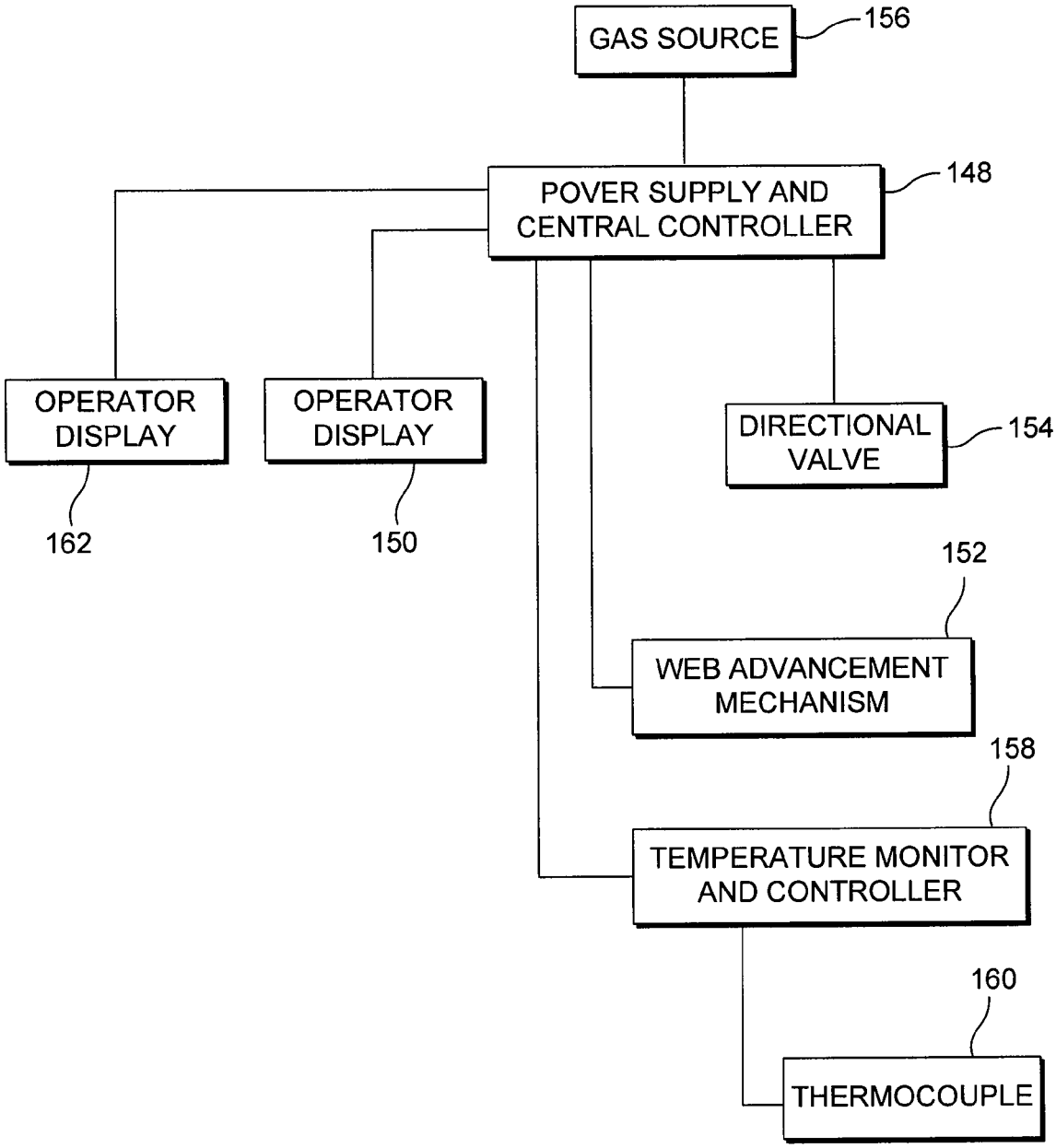
FIG. 14 is a block diagram showing device components according to an embodiment.

Turning now to FIG. 14, a schematic is shown displaying connections among control and power components according to one embodiment of the present disclosure. A power supply and central controller 148 reacts to operator inputs from an operator control 150 to power and control components of an inflation and sealing device according to one embodiment of the present disclosure. While the power supply and central controller 148 is shown as a single component in FIG. 14, it is to be understood that these may be two separate but interconnected components.

A web advancement mechanism 152, including for example motors for driving driven nip rollers, is connected to the power supply and central controller 148 for power and to accept startup, advancement speed, and shutdown control signals. A directional valve 154 is connected to the power supply and central controller 148 for supplied power and gas release control signals for operation during startup and shutdown of an inflation and sealing device. A gas source 156 is connected to the power supply and central controller to accept power and further to accept startup and shutdown signals. A temperature monitor and controller 158 is connected to the power supply and central controller 148 to accept power and temperature control signals and to report on sealing wire temperature using signals generated by a thermocouple 160. An operator display 162 may be connected to the power supply and central controller 148 to provide operation information to an operator.

One having ordinary skill in the art should appreciate that there are various configurations and embodiments according to exemplary embodiments of the present invention.

As used herein, the terms "front," "back," and/or other terms indicative of direction are used herein for convenience and to depict relational positions and/or directions between the parts of the embodiments. It will be appreciated that certain embodiments, or portions thereof, can also be oriented in other positions.

In addition, the term "about" should generally be understood to refer to both the corresponding number and a range of numbers. In addition, all numerical ranges herein should be understood to include each whole integer within the range. While an illustrative embodiment of the invention has been disclosed herein, it will be appreciated that numerous modifications and other embodiments may be devised by those skilled in the art. Therefore, it will be understood that the appended claims are intended to cover all such modifications and embodiments that come within the spirit and scope of the present invention.

What is claimed is:

1. A material web inflating, cutting and sealing device, comprising:

a device base having a mounting plate that includes a sealing mechanism mounted thereto; and a module that is removably mounted as a unit to the device base, wherein the module includes:

a module base formed by a plate that is removably attached within the mounting plate of the device base, an inflation nozzle configured to insert a fluid into a material web to create one or more inflated pillows, and a cutting mechanism configured to cut the material web as the material web passes over the inflation nozzle, wherein the nozzle and the cutting mechanism are mounted to the module base such that mounting the module base to the device base mounts the nozzle and cutting mechanism to the device base as a unit and into association with the sealing mechanism, which seals the web for sealing the fluid within the web.

2. The device of claim 1, wherein the sealing mechanism is configured for making a longitudinal seal to seal the inserted fluid between the web layers to form inflated pillows.

3. The device of claim 1, wherein the module base also includes at least one roller to guide the web along the inflation mechanism.

4. The device of claim 3, wherein the roller is a belt roller configured to support a belt of the advancement mechanism that advances the web along the longitudinal path.

5. The device of claim 1, wherein the device base mounting plate is a planar surface having features for receiving alignment features on the modular base plate from the side of the device base plate opposite the sealing mechanism.

6. The device of claim 3, wherein the module base plate includes a surface that is flush with the device base mounting plate when mounted thereon and a surface that mates with the device base plate when mounted thereon.

7. The device of claim 1, wherein the nozzle and blade are removably attached to the module base with the blade extending outwardly from the nozzle into the module base plate.

8. The device of claim 1, wherein the module includes a pair of pinch rollers to pinch the web from opposite sides.

* * * * *